US005568221A

United States Patent [19]

Hasegawa et al.

[11] Patent Number: 5,568,221

[45] Date of Patent: Oct. 22, 1996

[54] APPARATUS FOR PROCESSING SILVER HALIDE PHOTOGRAPHIC LIGHT-SENSITIVE MATERIAL

[75] Inventors: Takuji Hasegawa; Yasunori Wada; Syoji Nishio, all of Hino, Japan

[73] Assignee: Konica Corporation, Tokyo, Japan

[21] Appl. No.: 534,946

[22] Filed: Sep. 28, 1995

[30] Foreign Application Priority Data

Oct. 4, 1994 [JP] Japan ..... 6-240284

[51] Int. Cl.[6] ..... G03D 3/02

[52] U.S. Cl. ..... 396/630; 137/624.15; 222/129

[58] Field of Search ..... 354/320–324; 430/30, 398–400; 137/624.13, 624.15; 222/644, 129, 134–138, 146.1, 146.2

[56] References Cited

U.S. PATENT DOCUMENTS 3,822,723 7/1974 Crowell et al. ..... 354/297 X

FOREIGN PATENT DOCUMENTS

0537788A3 4/1993 European Pat. Off. ..... 354/324

5-127341 5/1993 Japan .

OTHER PUBLICATIONS

Patent Abstracts of Japan, vol. 017, No. 498 (1993) of JP–A–05 127341.

*Primary Examiner*—D. Rutledge

*Attorney, Agent, or Firm*—Frishauf, Holtz, Goodman, Langer & Chick, P.C.

[57] ABSTRACT

An apparatus for processing a silver halide photographic light-sensitive material with a processing solution is disclosed, comprising a processing tank containing the processing solution and replenishing means for replenishing the processing solution during the course of processing, wherein the replenishing means comprises two replenishing tanks each connected to the processing tank; a solid processing composition and water are supplied to each of the replenishing tanks to prepare a replenishing solution therein; while replenishment is being made from one of the replenishing tanks, the solid processing composition is supplied, together with water, to another replenishing tank to prepared another replenishing solution therein, and the preparation of the replenishing solution and replenishment thereof are repeated alternately in each of the replenishing tanks to perform continuous replenishment.

11 Claims, 2 Drawing Sheets

APPARATUS FOR PROCESSING SILVER HALIDE PHOTOGRAPHIC LIGHT-SENSITIVE MATERIAL

FIELD OF THE INVENTION

This invention relates to a processing method of a silver halide photographic light-sensitive material through an automatic processor and, particularly, to the preparation of the replenishing solution for the same.

BACKGROUND OF THE INVENTION

Heretofore, there have extensively studied up on the processes of silver halide photographic light-sensitive materials to be treated through an automatic processor and also on the replenishing solutions suitable to the same. As the results thereof, many processing compositions have currently been marketed in the form of a concentrated solution to be used upon diluting the same. However, such a concentrated solution as mentioned above are so heavy and bulky that the transportation costs and storage spaces are increased and, therefore, the improvements thereof have been demanded increasingly. As the means for solving the above-mentioned problems, a solid processing composition has been watched with deep concern. A solid processing composition is also preferred from the environmental viewpoint because it can save the consumption of the packaging materials.

However, a solid processing composition takes a time to be dissolved. There arises such a problem that the dissolution thereof may be too late or that a developing solution composition may not be stable, when a continuous processing are carried out under the recent rapid-processing conditions.

On the other hand, the chemical mixer having most popularly been used so far is such a process that a large amount of a processing solution is prepared in one and single preparation process. In this process, however, there have been a problem of the installation space of the chemical mixer, another problem of a replenishing solution instability caused by an air-oxidation when reserving a replenishing liquid for a long time, and so on.

SUMMARY OF THE INVENTION

The objects of the invention have been achieved for solving the above-mentioned problems.

In other words, it is an object of the invention to develop such a process for replenishing a processing solution that can cope with the case where continuous processing are performed even with the use of a solid processing composition under the super-rapid processing conditions as in recent times, and that any extra storage and transportation space required as in use of a concentrated processing solution can be eliminated.

The objects of the invention can be achieved by the following.

(1) A method for continuously processing a silver halide photographic material, using an automatic processor provided with at least a developing tank and a fixing tank, comprising
developing the photographic material with a developer, fixing the photographic material with a fixer and replenishing each of the developer and the fixer, wherein the processor is further provided with at least two replenishing tanks; a solid processing composition and water are supplied to the replenishing tanks, in which the solid composition is dissolved to prepare a replenishing solution; and, during the course of processing, the following actions (i) and (ii) are alternately repeated in each of the replenishing tanks to perform continuos replenishment, (i) while a first replenishing solution of a first replenishing tank is being replenished to the developing or fixing tank, said solid processing composition and water are supplied to a second replenishing tank to prepare a second replenishing solution therein and (ii) when replenishment of the first replenishing solution has been accomplished, the second replenishing solution prepared in the second replenishing tank is replenished to the developing or fixing tank.

(2) An apparatus for processing a silver halide photographic light-sensitive material comprising:
a developing tank containing a developer solution,
a fixing tank containing a fixer solution, and
replenishing means for replenishing the developer solution or the fixer solution, wherein said replenishing means comprises at least two replenishing tanks; a solid processing composition and water being supplied to the replenishing tanks, in which the solid composition is dissolved to prepare a replenishing solution, and wherein, according to the actions (i) and (ii) as described in (1), the preparation of the replenishing solution and replenishment thereof to the processing tank are alternately repeated in each of the replenishing tanks to perfrom continuous replenishment.

The problem concerning to a solubility of a solid processing composition in continuous processing has been solved and, at the same time, a replenishing solution stability and a space-saving have also been achieved in the following manner. At least two replenisher tanks for are provided to the inside of an automatic processor and, when the solid processing composition is being dissolved in one of the tanks, a solution in which the solid processing composition has been dissolved is replenished in an amount required for the process from the an other tank to a processing tank and both of the dissolution and replenishment are then alternately carried out in the tank.

It was discovered that a replenishing speed can be accelerated by providing a heating means to a tank for replenishing a solid processing composition and it is further effective to solve the above-mentioned problems.

Figure 1:
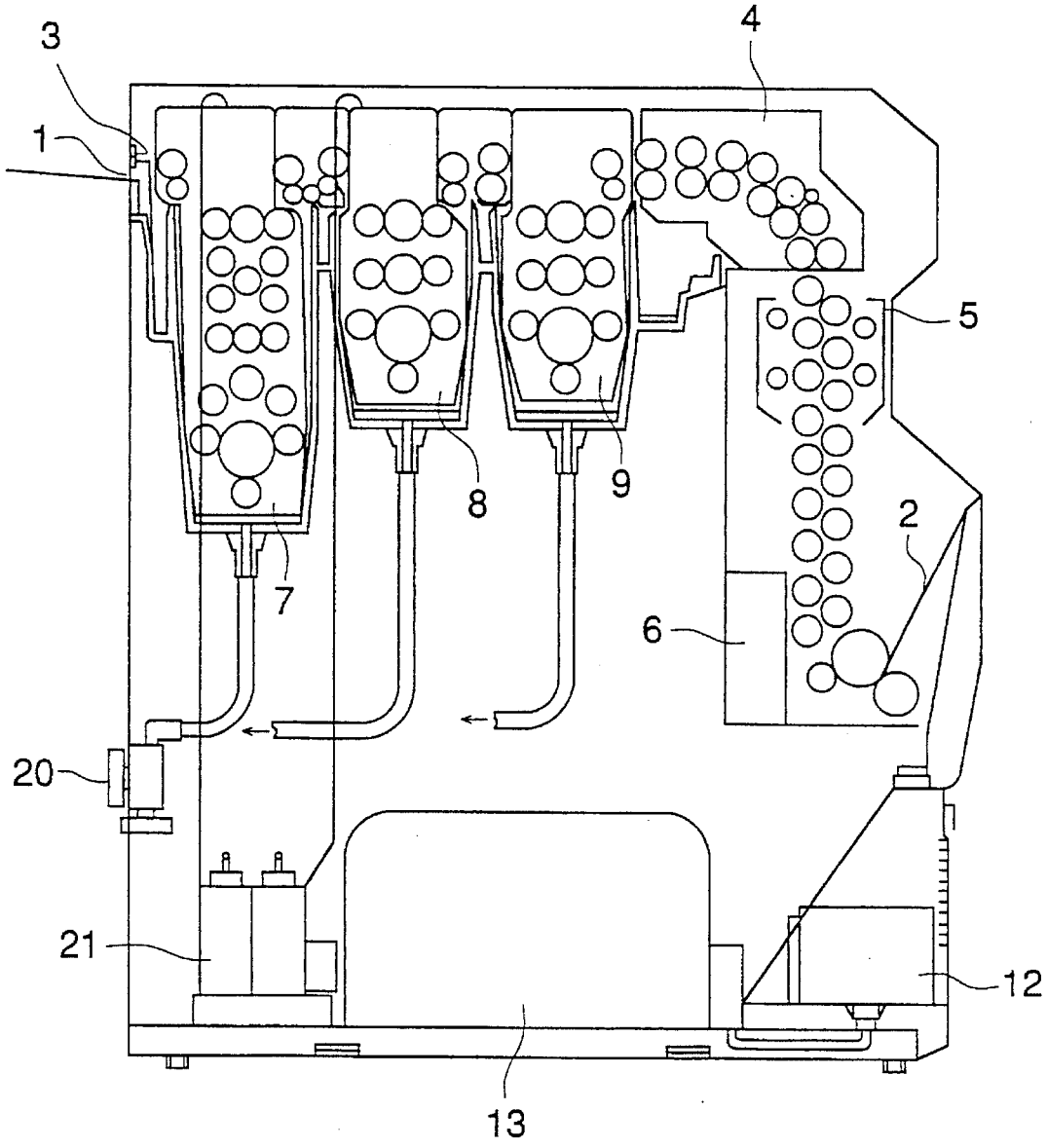
FIG. 1.

A schematic illustration of an automatic processor of the invention.

FIG. 2:

A perspective view of a replenish tank for replenishing a solid processing composition therein, provided to an automatic processor of the invention.

Description of the referential numerals:

1—A photographic material inlet

2—A photographic material outlet

3—A photographic material detecting section

4—A squeezing section

5—A drying section

6—A drier fan

7—A developing tank

8—A fixing tank

9—A washing tank

12—A solid processing composition reservoir

13—A replenishing tank section

14—Developer-replenishing tank—1

15—Developer-replenishing tank—2

16—Fixer-replenishing tank—1

17—Fixer-replenishing tank—2

19—A liquid level sensor attached to the bottom of a replenishing tank

DETAILED DESCRIPTION OF THE INVENTION

In the invention, the term, "a processing composition for replenishment to be used in an automatic processor", means a processing composition to be supplied to an automatic processor, with the following purpose. Even after starting the automatic processor in operation and then processing a light-sensitive material, it is to keep the ability of the processing composition that may be exhausted as the light-sensitive material is processed or as the automatic processor is put out of operation for a time.

The term, "a replenishing tank", means a tank provided to an automatic processor in which a processing solution for replenishment (replenisher) can be prepared by replenishing a solid processing composition supplied and then by supplying the resulting solution to such a processing tank as a developing tank. Usually, this tank has an inlet for a solid processing composition, an agitation-dissolution means and a means for supplying a prescribed quantity to a processing tank.

It is preferable that a replenishing tank has a capacity within the range of not smaller than 1/20 to not larger than 1/5 of the capacity of a processing tank in which a light-sensitive material is processed.

If a replenishing tank has a capacity larger than 1/5 of that of the processing tank, there raises such a problem that the replenishing tank will occupy a larger space in an automatic processor, and that a processing solution will be air-oxidized when the solution is preserved for a long time. If it is smaller than 1/20, there raises a problem of the shortage of time for replenishing a solid processing composition, and another problem of the increase of a replenishing pump driving energy consumption.

In the replenishing tank, it is preferable to use a floating cover made of a resin or the like capable of cutting off the contact with air so as to prevent an air-oxidation.

The term, "a solid processing composition", stated in the invention means powdered processing compositions and a solid processing composition in the form of a tablet, a globule and granules. If required, they may be moisture-proofed.

In the invention, the term, "powder", means an aggregate of fine crystals; "a granule" means a granular substance prepared by glanulating the powder in a granulation process, having a size of 50 to 5000 μm; and "a tablet" means that is prepared by compression-molding powder or granules into a certain form.

FIG. 1 illustrates an example of the schematic cross-sectional views of an automatic processor applicable to the invention. A photographic light-sensitive material inserted from inlet 1 is ejected from outlet 2, after passing through developing tank 7, fixing tank 8, washing tank 9, squeezing section 4 and drying section 5. There is solid processing composition storage section 12 at the lower right section of the automatic processor, and replenishing tank section 13 for replenishing processing compositions for replenishment use is at the bottom of the center of the automatic processor. By a signal sent by a signal system, a prescribed quantity of solid processing composition is transferred from solid processing composition storage section 12 to replenishing tank 13 and is then supplied to a processing tank such as developing tank 7 of the automatic processor. In the figure, 20 is a cock for the effuluent from a processing tank, and 21 is a plump for replenishment.

Figure 2:
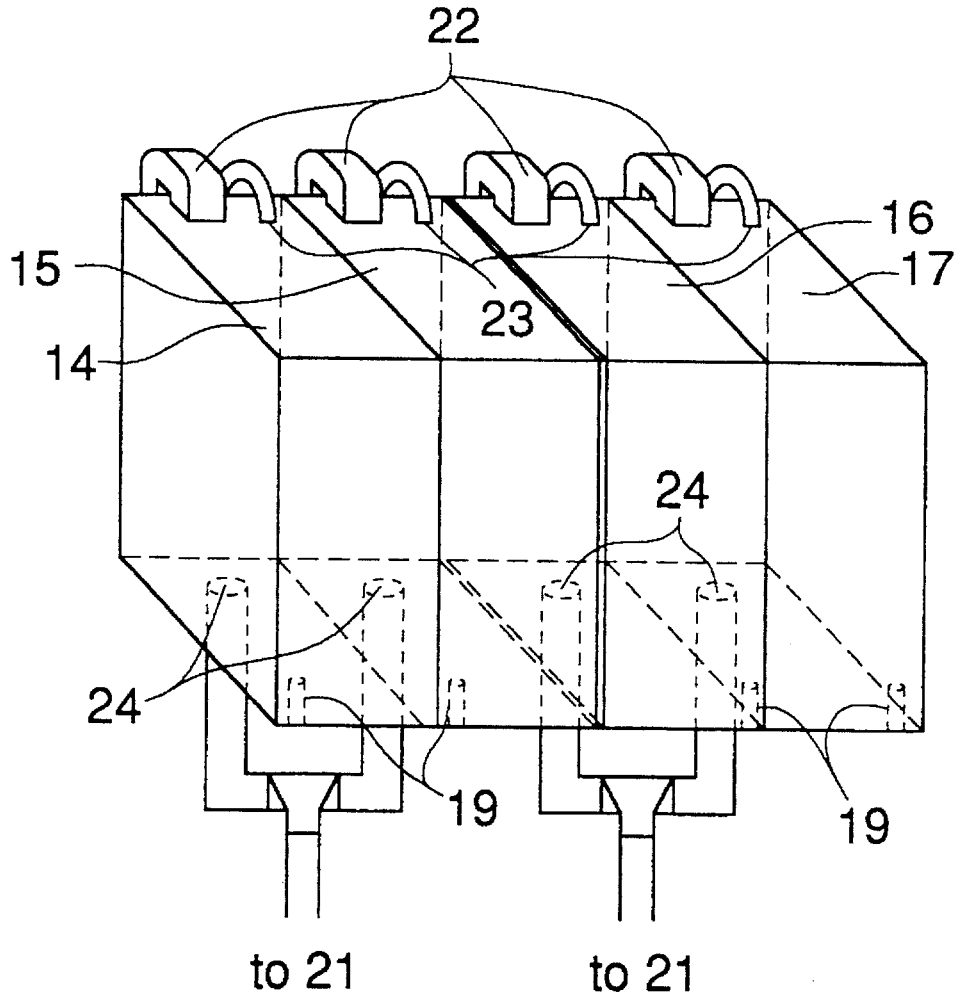

As shown in FIG. 2, replenishing tank section 13 has a developer-replenishing tank and a fixer-replenishing tank. Further, the developer-replenishing tank and fixer-replenishing tank are each divided into two tanks, namely, developer-replenishing tanks-1, -2 and fixer-replenishing tanks-1, -2, (the four tanks are numbered by 14, 15, 16 and 17, respectively.) To the upper part of each tank, solid processing composition inlet 22 and replenishing water cock 23 are provided; and, to the lower part thereof, processing solution-replenishing inlet 24 is provided.

Before starting the operation of an automatic processor, various kinds of check-up are made. When the automatic processor is ready for operation and a signal for inserting a light-sensitive material is then inputted from light-sensitive material detection section 3, the automatic processor is started in operation.

In the invention, a detection is also made when the above-mentioned check-up is made, on whether each of replenishing solutions is reserved so that developer-replenishing tanks 14 and 15 and fixer-replenishing tanks 16 and 17 may be operable. If the automatic processor is not ready for operation, a processing compositions is transferred from solid processing composition storage section 12 to replenishing tank section 13, so that the processing compositions for replenishment is dissolved to be ready for operation. About developer-replenishing tanks 14 and 15, if either one can be ready for replenishment, the operation will be made.

After starting the operation, a replenishment is started from a replenishing tank in the replenishable state (developer-replenishing tank-14 in this instance) to a developing tank. In developer-replenishing tank-15, a solid developer composition supplied from the storage section 12 begins to be dissolved to prepare a replenishing solution. When the replenishing solution of tank 14 is detected to be exhausted by liquid level sensor 19 located at the lower part of replenishing tank-14, the replenishment to the developing tank is continued by switching replenishing tank-14 to replenishing tank-15 in which the dissolution and preparation of the solution have already been completed at that time. In developer-replenishing tank-14 from which the replenishment has been completed, the developer for a solid developer composition is supplied thereto and the dissolution thereof then starts, so that the tank-14 may be ready for the next replenishment. By repeating the above-mentioned steps, the replenishments can be made to the processing tanks continuously, even when a developer replenishig solution is prepared from a solid developer composition and a rapid processing is then carried out therewith. In FIGS. 1 and 2, the replenishing mechanism for a fixer is the same as in the developer as above-mentioned.

For preparing a solid photographic processing composition, for example, the composition may be molded upon kneading a concentrated photographic processing solution or a finely powdered or granulated photographic processing compositions with a water-soluble binder; or, a water-soluble binder is sprayed over the surface of a preliminarily molded photographic processing composition so as to form a coated layer, as disclosed in Japanese Patent Application Open to Public Inspection (hereinafter referred to JP OPI Publication) Nos. 4-29136(1992), 4-85535(1992), 4-85536(1992), 4 -85533(1992), 4-85534(1992) and 4-172341(1992).

As a preferable tableting processe include, for example, a powdered solid processing composition is granulated and then the tablet is formed in a tableting process. The tablet has advantageously improved solubility and preservability, as compared to a solid processing composition formed simply by tableting a mixture of the solid processing chemicals together in a tableting process.

The granulating processes for forming a tablet include, for example, well-known processes such as a rolling granulation process, an extruding granulation process, a compression granulation process, a cracking granulation process, a stirring granulation process, a moving bed granulation process and a spray-drying granulation process. For forming a tableted composition, the average size of the granulates is to be preferably 100 to 800 μm and more preferably 200 to 750 μm, from the viewpoint that a component unevenness can hardly be produced when mixing and compressing granulates. It is further preferable that not less than 60% of granules have granular sizes within a deviation range between ±100 to ±150 μm. Next, when compressing the resulting granules, any compressors such as a hydraulic press, a single-shot tableting machine, a rotary tableting machine, or a briquetting machine can be used. The solid processing composition formed by compression-molding can take any desired form. Preferably, it is to be of cylindrical form, so-called a tablet form, from the viewpoint of productivity and handling conveniences or taking a dust problem into consideration when it is used by the users.

It is further preferable to separately granulate each of components such as an alkalizer, a reductant and a preservative.

The tablet-formed processing composition can be prepared by well-known processes described in, for example, JP OPI Publication Nos. 51-61837(1976), 54-155038(1979) and 52 -88025(1977), British Patent No. 1213808 and so forth. The granular processing composition can also be prepared by processes, as described in, for example, JP OPI Publication Nos. 2-109042(1990), 2-109043(1990), 3-39735(1991) and 3-39739(1991), and so forth. The powdered processing compositions can further be prepared by processes, as described in, for example, JP OPI Publication No. 54 -133332(1979), British Patent Nos. 725,892 and 729,862, German Patent No. 3,733,861, and so forth.

In the case that the above-mentioned solid processing composition is in the form of a tablet, the bulk density thereof is preferable to be within the range of 1.0 g/cm$^3$ to 2.5 g/cm$^3$ from the viewpoints of the solubility thereof and the effects of the objects of the invention. Thus, it is preferably 1.0 g/cm$^3$ or more from the view point of the hardness thereof and 2.5 g/cm$^3$ or less from the view point of solubility. In the case that the solid processing composition is in the form of granules or powder, it is preferable when the bulk density thereof is within the range of 0.40 to 0.95 g/cm$^3$.

The solid processing composition applicable to the invention may be used for photographic processing compositions such as a developer, a fixer and a rinse. When it is used for a developer, the effects of the invention, inter alia, the effect for stabilizing photographic characteristics is remarkable.

Furthermore, a processing composition prepared by solidifying a part of processing shall also be included in the scope of the invention. It is however preferable that the whole components of the chemicals are solidified. It is also preferable that each of the components is molded separately as each individual solid processing composition and that all of them are packed together in one and the same package. It is also preferable that the separate components are packed in such an order as they are used periodically and repeatedly by turns.

It is preferable that each of processing solutions that are to be replenished to the processing tanks in response to informations on the processing quantity is prepared by the solid processing composition. In the case that replenishing water is required, it is replenished according to a processing quantity information or a separate replenishing water control information. In this case, a replenisher to be replenished to a processing tank can be controlled to be only replenishing water. Thus, in the case of plural the processing tanks required to be replenished, a water-replenishment may be done from a single replenishing water reservoir tank by sharing the replenishing water, so that an automatic processor can be made compact in size. A replenishing water tank may be installed outside of the processor and it may also be built into the processor. However, a built-in replenishing tank is preferable from the viewpoint of space-saving.

The packages for the solid processing composition of the invention can be embodied by making use of such materials as given above. A synthetic resin material applicable thereto include any one of polyethylene (prepared in either one of a high pressure process or a low pressure process), polypropylene (either non-stretched or stretched), polyvinyl chloride, pollvinyl acetate, nylon (either stretched or non-stretched), pollvinylidene chloride, polystyrene, polycarbonate, vinylon, Eval, polyethylene terephthalate (or PET), other polyesters, rubber hydrochloride, an acrylonitrile butadiene copolymer, and an epoxy-phosphoric acid type resin (such as the polymers given in JP OPI Publication No. 63 -63037(1988) and the polymers given in JP OPI Publication No. 57-32952(1982). Besides the above, pulp is also applicable thereto.

As for the materials, a single material is preferred. When making use thereof, as a film, the films may be adhesively laminated together. They may also be a coated layer.

It is further preferable to make use of various kinds of gas-barrier layer prepared by, for example, interposing an aluminum foil or an aluminum vapor-deposited synthetic resin between the above-mentioned synthetic resin films.

For keeping the preservability of a solid processing composition or for preventing stains, the oxygen permeability of these packaging materials are preferably not higher than 50 ml/m$^2$ 24 hr·atm (at 20° C. and 65% RH) and more preferably not higher than 30 ml/m$^2$ 24 hr·atm.

The total thickness of the above-mentioned laminated layer or single layer is within the range of 1 to 3000 μm, preferably 10 to 2000 μm and more preferably 50 to 1000 μm.

The above-mentioned synthetic resin film may be either a single, or not less than two laminated (polymer) resin layer.

Such a sealant (or a film for sealing use) as mentioned above is used upon laminating polyethylene, polypropylene, polystyrene, polycarbonate, polyester, polyvinyl chloride, nylon, evar or aluminum. However, such a sealant as mentioned above is thin. Therefore, taking the moisture-proof, environmental adaptability and matching to the package contents into consideration, polyethylene, polypropylene, polyester and evar are preferred. Besides, taking a printability into consideration, the outermost surface thereof is preferable to be made of non-stretched polypropylene, polyester, paper or the like.

The sealant films include, for example, CMPS film manufactured by Tocello Co., Difran PP-100 and PS-300 manufactured by Dai-Nippon Ink Co., LTS film manufactured by Toppan Printing Co., and Sun-seal FR and Sun-Seal MS manufactured by San-Ei Chemical Co. Films polyester-laminated in advance include, for example, Dikran C-1600T and C-1602T.

PTP is of a kind of such a blister package style that a solid processing composition is put in a molded sheet and is the heat-sealed with an aluminum-made sealing material.

When packaging, binding or covering a processing composition with a water-soluble film or a binder, it is preferable to make use of a film or a binder each comprising a base material of the poll/vinyl alcohol type, methyl cellulose type, polyethylene oxide type, starch type, pollvinyl pyrrolidone type, hydroxypropyl cellulose type, pullulan type, dextran type, gum arabic type, polyvinyl acetate type, hydroxyethyl cellulose type, carboxyethyl cellulose type, carboxymethyl hydroxyethyl cellulose sodium salt type, poly(alkyl) oxazoline type or polyethylene glycol type. Among them, a pollvinyl alcohol type and pullulan type are more preferably be used from the viewpoint of covering or binding effect.

The above-mentioned preferable pollvinyl alcohol is a very excellent film forming material and has an sufficient strength and flexibility mostly under any conditions. A polyvinyl alcohol composition have been marketed, that is produced by molding it into a film, is various in the degree of molecular weight or hydrolysis. It is, however, preferable to have a molecular weight within the range of 10,000 to 100,000, approximately. The term, "degree of hydrolysis", means herein a ratio of an acetate group of polyvinyl alcohol substituted to a hydroxyl group. For applying such a polyvinyl alcohol to a film, the hydrolysis range thereof is ordinarily within the range of 70% to 100%, approximately. As mentioned above, the term, "polyvinyl alcohol", usually includes a polyvinyl acetate compound.

The above-mentioned water-soluble films are produced in such an conventional process as described in, for example, JP OPI Publication Nos. 2-124945 (1990), 61-97348 (1986), 60 -158245(1985), 2-86638 (1990), 57-117867 (1982), 2-75650 (1990), 59-226018 (1984), 63-218741 (1988) and 54-13565 (1979).

For the above-mentioned water-soluble films, those having the trade names such as Solvlon (manufactured by Aicello Chemical Co.), Hicellon (manufactured by Nichigo Film Co.) or Pullulan (manufactured by Hayashibara Co.) may be used. Particularly, 7-000 Series of pollvinyl alcohol film available from MONO-SOL Division of Chris Craft Industries, Inc. can preferably be used, because they are soluble in water at a temperature within the range of 34° F. to 200° F. and they have a high chemical resistance without any toxicity.

The thickness of the above-mentioned water-soluble films is to be within the range of, preferably, 10 to 120 μ, more preferably 15 to 80 μ and particularly 20 to 60 μ, from the viewpoints of the preservation stability of a solid processing composition, the replenishing time of a water-soluble film and a crystal deposition produced in an automatic processor used.

The water-soluble film is preferable to be thermoplastic, because not only a heat-seal process and supersonic fusing process can readily be performed, but also a covering effect can excellently be displayed.

Further, the tensile strength of a water-soluble film is to be within the range of, preferably, $0.5\times10^6$ to $50\times10^6$ kg/m$^2$, more preferably $1\times10^6$ to $25\times10^6$ kg/m$^2$ and particularly $1.5\times10^6$ to $10\times10^6$ kg/m$^2$. The tensile strength thereof can be measured in the procedures described in JIS Z-1521.

A photographic processing composition packed, bound or covered by a water-soluble film or a binder is preferable to be packaged with a moisture-proof packaging material so as to protect it from such a damages as may be produced by a moisture in the air such as high humidity, rain or mist, or as may be brought into accidental contact with water by a wet hand. The above-mentioned moisture-proof packaging materials include preferably a film having a thickness within the range of 10 to 150 μ. The material thereof is preferably at least one selected from the group consisting of those made of polyethylene terephthalate or polyethylene, a polyolefin film such as made of polypropylene; those made of a craft paper having a moisture-proof effect provided with polyethylene; those made of wax paper; those made of moisture-proof cellophane, glassine, polyester, polystyrene, polyvinyl chloride, polyvinylidene chloride, polyamide, polycarbonate or acrylonitrile; a metal foil such as made of aluminum; and a metallic polymer film. Besides the above, a composite material thereof may also be used for.

In an embodiment of the invention, it is also preferable to use a moisture-proof packaging material made of a decomposable plastic, particularly, such as a biodegradable or photodegradable plastic.

The above-mentioned biodegradable plastic include, for example, one comprising a natural polymer, a microbiological polymer, a well-biodegradable synthetic polymer, and a biodegradable natural polymer compounded with a plastic. The above-mentioned photodegradable plastic include, for example, one comprising the principal chain having a group so excited by UV rays as to produce a scission. Besides the above-given high polymers, one having both photodegradation and biodegradation properties at the same time can also excellently be used for.

The concrete and typical examples thereof will be given below.

The biodegradable plastics include, for example, (1) Natural polymer

Polysaccharide, cellulose, polylactic acid, chitin, chitosan, polyamino acid, or the modification thereof, and so forth;

(2) Microbiological polymer

"Biopol" comprising PHB-PHV (a copolymer of 3-hydroxybutylate and 3-hydroxyvalerate), a biological cellulose, and so forth;

(3) Well-biodegradable synthetic polymer

Polyvinyl alcohol, potycaprolactone, the copolymers thereof or the mixtures thereof;

(4) Plastics compounded with biodegradable natural polymer

Well-biodegradable natural polymers include, for example, starch and cellulose, each of which is provided with a shape decaying property by adding it to plastics;

(5) Photodegradation type properties include, for example, the introduction of a carbonyl group capable of providing a photodegradability. Further, a UV absorbent may sometimes be added thereto for accelerating the degradation reaction.

For such a degradable plastics mentioned above, it is allowed to make use of those generally described in, for example, "Science and Industry", Vol. 64, No. 10, pp. 478–484, "Functional Materials", July, 1990 Issue, pp. 23–34, and so forth. It is also allowed to make use of degradable plastics available on the market including, for example, Biopol (manufactured by ICI), Eco (manufactured by Union Carbide Co.), Ecolite (manufactured by Eco Plastics Co.), Ecostar (manufactured by St.Lawrence Starch Co.), and Knuckle-P (manufactured by Japan Unicar Co.).

The above-mentioned moisture-proof packaging materials are to have a water permeability coefficient of not higher than 10 g·mm/m$^2$ 24 hr and preferably not higher than 5 g·mm/m$^2$ 24 hr.

In the invention and when the solid processing composition is of the tablet type, for example, the means for supplying the solid processing composition to a replenishing tank include any well-known means such as described in Japanese Utility Model OPI Publication Nos. 63-137783(1988), 63-97522(1988) and 1-85732(1989). At any rate, any means may be used for, provided that a function of supplying a solid processing composition to a replenishing tank can at least be performed. When a solid processing composition is of the granular or powdered type, there are well-known systems such as a gravity dropping system described in, for example, Japanese Utility Model OPI Publication Nos. 62-81964(1987), 63-84151(1988) and 1-292375(1989), and a screw system described in, for example, Japanese Utility Model OPI Publication Nos. 63-105159(1988) and 63-195345(1988). However, the systems shall not be limited thereto.

One of the means for supplying a solid processing composition to a replenishing tank is, for example, a means that a prescribed amount of solid processing composition having been weighed and dividedly packaged in advance and the package is unsealed to be taken out in an amount so as to meet the quantity of light-sensitive materials to be processed. To be more concrete, every specific amount and, preferably, every amount for individual replenishment of the solid processing chemica is packaged sandwichwise between packaging members comprising at least two packaging materials, and the solid processing composition may be made ready for taking out by separating the packaging members into two directions or by unsealing a part of each packaging member. The solid processing composition having been ready to taking out can easily be supplied to a replenishing tank having a filtration means, by a spontaneous dropping. A specific amount of each solid processing composition is packed in a dividedly sealed package so as to shield them from the open air and the aeration between a solid processing composition and another adjacent processing composition. It is, therefore, desirable that the moisture-proofing property of the composition can be secured unless the packages is unsealed.

As an embodiment thereof, it is to be constituted in such a manner that a packaging member comprises at least two packaging materials so as to sandwich a solid processing composition, and that the surfaces of the solid processing composition and the packaging member may be brought into close contact or adhered to each other so that the packaging member can separate the circumference of the solid processing composition. When pulling each packaging material sandwiching a solid processing composition in the different directions, the surfaces of them coming into close contact with or adhering to each other may be separated, so that the solid processing composition can be ready for taking out of the package.

As another embodiment thereof, it is to be constituted in such a manner that a packaging member comprises at least two packaging materials so as to sandwich a solid processing composition therebetween, and that at least one of them can be unsealed by external force. The expression, "unsealing" herein stated means an incision or a fracture remaining a part of a packaging material uncut. It may be considered to unseal a packaging material in such as manner that a solid processing composition is forcibly pushed out by applying compression from a packaging member on the unsealed side through the solid processing composition to the direction of the unsealable packaging member, or that a solid processing composition can be made ready for taking it out by applying an incision to the packaging member on the unsealable side by making use of a sharp-edged member.

A supply-starting signal can be received by detecting the information on an amount to be processed. A supply-sloping signal can be received by detecting an information on the supply completion of an amount to be processed. When a processing composition is dividedly enveloped and an unsealing is required, a driving means is started in operation for separating or unsealing a packaging member according to a supply-starting signal received and the driving means for separating or unsealing the packaging member can then be controlled to suspend the operation.

The above-mentioned solid processing composition supply means has a controlling means for putting a specific amount of solid processing composition so as to meet the information on a quantity of light-sensitive material to be processed, that is an essential requirement in the invention.

An information on a processing quantity of light-sensitive material means a quantity of light-sensitive material to be processed or having been processed or a value proportional to light-sensitive material being processed with a processing solution, and it indicates indirectly or directly an amount of processing chemicals being reduced in the processing solution. It may be detected at any point of time before or after the light-sensitive material is introduced into the processing solution, or during the light-sensitive material is dipped in the processing solution. Further, the above-mentioned information may also be a concentration of a processing solution composition or the changes thereof or such a physical parameter as a pH and a specific gravity. Such an information as mentioned above may further be an amount of a processing solution coming outside after drying the processed light-sensitive material.

Generally in an automatic processor, the temperature of a processing solution loaded therein is controlled by an electric heater. As for a general method thereof, a heat exchanger section is provided to an auxiliary tank connected to a processing tank and a heater is also provided thereto, and a pump is further arranged so as to circulate a given amount of the solution from the processing tank to the auxiliary tank and keep the temperature constant.

For the purpose of removing a crystallized foreign substance contained in a processing solution or produced in a crystallization, a filter is usually arranged. It is allowed to connect a replenishing tank to a section connected to a processing section, such as the above-mentioned auxiliary tank.

All materials of the filters, filtration devices and so forth applicable to any ordinary automatic processors can also be used in the invention, and a specific structures and materials shall not affect the effects of the invention.

In the invention, the circulation frequency of a processing solution circulated by a circulation means is to be within the range of, 0.5 to 2.0 times/minute, preferably 0.8 to 2.0 times/minute and more preferably 1.0 to 2.0 times/minute. The expression, "a circulation frequency", herein is related to a flow rate of a liquid to be circulated, and one circulation herein means when a liquid amount corresponding to the total liquid amount reserved in a processing tank is flowed out.

Now, an antimolding means of a water replenishing tank of an automatic processor relating to the invention will be detailed. When a liquid exchange rate of a water replenishing tank is lowered so that a water retention time is prolonged, there raises such a problem that a fur is produced and a bad smell is also produced after 2 to 3 weeks, because water contained in the tank is spoilt. If a fur produced is replenished as it is, there raises such a serious problem that the fur adheres to a photographic material so that a development unevenness is produced when the fur adheres to a developing tank, and a fixing failure is produced so that the commercial value is seriously spoilt when the fur adheres to a fixing tank. Therefore, every tank is to be cleaned up periodically for removing a fur, so that it takes much time and requires much labor. Therefore, a water supplying tank of the invention has an antimolding means. The antimolding means can be achieved by at least one means selected from the group consisting of the following means.

1. A chelating agent adding means,
2. An antimold adding means,
3. A deionizing means,
4. A UV-ray irradiating means,
5. A magnetic treating means,
6. A supersonic treating means,
7. An electrolytic pasteurizing means,
8. A silver-ion releasing means,
9. An air bubbling means,
10. An active oxygen releasing means,
11. A means for coming into contact with a porous material,
12. A means for adding other harmless fungus to prevent any multiplication of harmful fungi.

Now, the above-mentioned means will concretely be detailed. As for the chelating agents and pasteurizers applicable to serve as an antimolding means in the invention, the following compounds can be used for example; namely, those given in L. E. West, "Water Quality Criteria", Phot Sci. and Eng., vol.9, No.6, p.398 (1965); M. E. Beach, "Microbiological Growth in Motion Picture Processing", SMPTE Journal, vol.85, (Mar., 1978); R. O. Deegan, "Photoprocessing Wash Water Biocides", J. Imaging Tech., vol.10, No.6, p.239, (Dec., 1984); JP OPI Publication Nos. 57-8542(1982), 58-105145(1983), 57-157244(1982) and 62-220951(1987); and so forth.

The chelating agents preferably applicable to the invention include, for example, ethylenediamine tetraacetic acid, diethylenetriamine pentaacetic acid, 1-hydroxyethylidene-1, 1-diphosphonic acid, ethylenediamine tetra(methylene phosphonic acid), 2-hydroxy-4-sulfophenol and 2-hydroxy-3,5-disulfophenol. The pasteurizers include, for example, a phenol type compound, a thiazole type compound and a benztriazole type compound. To be more concrete, the preferable compounds thereof include, for example, 1,2-benzisothiazoline-3-one, 2-methyl-4-isothiazoline-3-one, 2-octyl-4-isothiazoline-3-one, 5-chloro-2-methyl-isothiazoline-3-one, Sodium O-phenylphenol and benztriazole. When these compounds are collectively packed in one lot, they are preferable to be in the tablet form. When they have been dividedly weight in advance, they are preferable to be packed individually in an amount for a single usage.

As for the means for adding the chelating agent and pasteurizer, it is allowed that a chemical preparator may add them by hand. It is however preferable that a solid processing composition supply device is provided and they may be added thereby, and it is more preferable that a detector is provided to a water replenishing tank and they are automatically added when water is replenished up to a certain level of the tank, from the viewpoint of maintenance-free.

A means of the invention for modifying water with an ion-exchange resin can be embodied according to the means described in, for example, JP OPI Publication No. 61-131632(1986).

The above-mentioned ion-exchange resins include, for example, various kinds of well-known cation-exchange resins (such as a strong acid type cation-exchange resin and a weak acid type cation-exchange resin) and various kinds of anion-exchange resins (such as a strong base type anion-exchange resin), of which are described in Technical Reports Laid Open to Public Inspection No. 90-473 and so forth. They may be used singly or in combination. It is ordinarily preferable to use a strong acid type H cation-exchange resin and a weak base type OH anion-exchange resin. It is also allowed either that they may be provided to a water replenishing tank, or that water may be modified at a separate place.

The preferable strong acid type ion-exchange resins include, for example, DIAION SK1B SK102, SK104, SK106, SK110, SK112 and SK116 (each manufactured by Mitsubishi Chemical Industries Co.), and the preferable Strong Base type OH Anion-exchange resins include, for example, DIAION PA406, PA408, PA412, PA416 and PA418 (each manufactured by Mitsubishi Chemical Industries Co.).

The means for irradiating UV rays can be embodied by, for example, the means described in JP OPI Publication No. 60-263939(1985). As for the UV-ray irradiation device, that manufactured by Kindai-Bio Laboratories, Inc. may preferably be used, because it is small in size. The means for generating a magnetic field may be embodied by such a means as described in JP OPI Publication No. 60-263939(1985). The means for applying supersonic waves may be embodied by such a means as described in JP OPI Publication No. 60-262940(1985). The means for applying an electrolysis may be embodied by such a means as described in JP OPI Publication No. 3-22468(1991). The means for releasing Ag ion include, for example, such a means that a silver foil or silver plate is put in a water replenishing tank, that the inner wall of the tank is coated with silver, or that a silver-ion dischargeable compound is put in a water-replenishing tank.

The air bubbling means may be a very simple means in which air bubbles are blown into a water replenishing tank. The means may suitably be selected so as to match with the size of a water replenishing tank. As for the means for preventing water fur and microbe production, those of Nos. 1, 2, 3, 7 and 8 may preferably be used from the viewpoints of the compact size and economical efficiency. It is more preferable to select No. 1, 3 or 8.

The silver ion releasing compounds for Means No. 8 include, for example, silver chloride, silver bromide, silver iodide, silver oxide, silver sulfate and silver nitrate, and such an organic acid silver as silver acetate, silver oxalate, silver behenate and silver maleate.

In the invention, it is preferable to use the above-mentioned silver compound contained in either an $SiO_2$-$Na_2O$ type glassy substance having a network structure as the chemical structure thereof, or a zeolite having a tree-dimensional skeleton structure in which each of a methane type structured $SiO_4$ tetrahedron and an $AlO_4$ tetrahedron holds one oxygen atom in common.

The above-mentioned silver compounds, and a zeolite and a glassy substance each containing a silver compound may be commercially available. For example, they include Bio-Sure SG manufactured by Kinki Pipe Engineering Laboratories, Inc., Opargent Tablet manufactured by Opopharma AG (in Switzerland) and Zeomic manufactured by Cinnanen Zeomic Co.

Further, a silver compound and a zeolite or glassy substance containing a silver compound each relating to the invention may be used in any forms. For example, they may be powder-form, globular-shaped, pellet-shaped, fibriformed or filter-shaped. Or, they may also be used upon kneading them in such a fiber as cotton, wool and polyester fiber. As a example thereof is cited SANITER 30 manufactured by Kuraray Co.

Among them, the filter-shaped and globular-shaped ones are included in the preferable embodiments in the invention.

Further, one of the preferable embodiments of the invention also include such an embodiment that the silver compound, or zeolite or glassy substance containing the silver compound, is used upon putting it in a plastic case or a water-permeable container such as a tea-bag. Besides the above, Clinka 205 manufactured by Nippan Laboratories, Inc and Ruckin manufactured by Pacific Chemical Co. may also preferably be used.

It is preferable that the surface of a solid processing composition applicable to the invention is covered by a compound represented by Formula [1], [2], [3] or [4] which is given in JP Application No. 6-70860(1994). It is particularly preferable that they are used together with a water-soluble polymer or a sugar in combination.

It is preferable to use a sugar compound given in JP Application No. 5-186254(1993) and a coating compound given in JP Application No. 6-91987(1994).

In a developer applicable to the invention, the following developing agents may preferably be used; namely, a dihydroxy benzene, an aminophenol and a pyrazolidone each given in JP OPI Publication No. 6-138591(1994) and, besides, a reducton given in JP Application No. 5-165161(1993) may also preferably be used. Among the pyrazolidones, 4th position-substituted are (such as Dimeson and Dimeson S) is particularly preferred, because of being superior in water-solubility and aging stability.

As for a preservative, not only a sulfite given in JP OPI Publication No. 6-138591(1994), but also an organic reducing agent may be used. Besides the above, a chelating agent disclosed in JP Application No. 4-586323(1992) (See p.20) and a bisulfite adduct of a hardener, as is disclosed in ibid., (See o.21) may be used. It is further preferable to add a compound as a silver-sludge preventive given in JP OPI Publication Nos. 5-289255(1993) and 6-308680(1994), (See Formulas [4-1] and [4-b]). The addition of a cyctodextrin compound is also preferable, and a compound given in JP OPI Publication No. 1-124853(1989) is particularly preferable.

It is also allowed to add an amine compound to a developer of the invention. For this purpose, a compound as disclosed in U.S. Pat. No. 4,269,929 is preferable.

A buffer is required to use in a developer applicable to the invention. The buffers include, for example, sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and so forth.

If required, the following compounds may be added as a development accelerator; namely, a thioether type compound given in JP Examined Publication Nos. 37-16088(1962), 37- 5987(1962), 38-7826(1963), 44-12380(1969) and 45-9019(1970) and U.S. Pat. No. 3813247; a p-phenylenediamine type compound given in JP OPI Publication Nos. 52-49829(1977) and 50 -15554(1975); a quaternary ammonium salt given in JP OPI Publication No. 50-137726(1975), JP Examined Publication No. 44-30074(1969) and JP OPI Publication Nos. 56-156826(1981) and 52-43429(1977); a p-aminophenol given in U.S. Pat. Nos. 2,610,122 and 4,119,462; an amine type compound given in U.S. Pat. Nos. 2,494,903, 3,128, 182, 4,230,796 and 3,253,919, JP Examined Publication No. 41-11431(1966) and U.S. Pat. Nos. 2,482,546, 2,596,926 and 3,582,346; a polyalkylene oxide given in JP Examined Publication Nos. 37-16088(1962) and 42 -25201(1967), U.S. Pat. No. 3,128,183, JP Examined Publication Nos. 41-11431(1966) and 42-23883(1967) and U.S. Pat. No. 3,532,501; and, besides, a 1-phenyl-3-pyrazolidone, a hydrazine, a mesoionic type compound, an ionic type compound, an imidazole, and so forth.

Antifoggants applicable to the invention include, for example, an alkali metal halide such as potassium iodide, and an organic antifoggant. The organic antifoggants include, for example, benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolidine, a nitrogen-containing heterocyclic compound such as adenine and, typically, 1-phenyl-5-mercaptotetrazole.

In a developer composition applicable to the invention, the following compounds are allowed to use, if required, as an organic solvent for increasing the solubility of the developing agent; namely, methyl cellosolve, methanol, acetone, dimethyl formamide, a cyclodextrin compound and, besides, a compound given in JP Examined Publication Nos. 47 -3378(1972 and 44-9509(1969).

Further, Various additives such as an antistaining agent, an antisludging agent and an interlayer-effect accelerator may also be used therein.

To a fixer applicable to the invention, well-known compounds may be added as a fixer, and a fixing agent, a chelating agent, a pH buffer, a hardener, a preservative and so forth may also be added thereto. For example, those given in JP OPI Publication Nos. 4-242246(1992) (See p.4) and 5 -113632(1993) (See pp.2–4). Besides the above, it is also allowed to add a chelating agent given in JP Application No. 4-586323(1992) as a hardener, a bisulfite adduct for a hardener given in ibid., and a fixing accelerator.

In advance of carrying out processing, it is preferable to add a starter and it is also preferable to add a starter in a solid form. The starter contains, for example, an organic acid such as a polycarboxylic acid compound and, besides, an alkaline earth metal halide such as KBr, an organic inhibitor and a development accelerator.

There is no special limitation to a silver halide photographic light-sensitive material applicable to the invention. However, those preferably applicable will be given below.

An emulsion applicable to a silver halide photographic light-sensitive material applicable to the invention may be prepared in any well-known processes. For example, the preparation thereof can be performed in Emulsion Preparation and Types described in Research Disclosure (RD) No. 17643 (Dec., 1978), Article 1 appeared on pp.22–23 and, the process described in ibid., No. 18716 (Nov., 1979), p.648. Besides, an emulsion can also be prepared in the process described in T. H. James, "The theory of the photographic process", 4th Ed., Macmillan Publishing Co., (1977), pp.38–104; a process described in G. F. Dauffin, "Photographic Emulsion Chemistry", Focal Press, (1966); a process described in P. Glafkides, "Chimie et physique photographique", Paul Montel, (1967); a process described in V. L. Zelikman, "Making and Coating Photographic Emulsion", Focal Press, (1964); and so forth.

A silver halide emulsion preferably applicable includes, for example, internally high iodine-containing type monodispersed grains disclosed in JP OPI Publication Nos. 59-177535(1984), 61-802237(1986), 61-132943(1986) and 63-49751(1988), JP Application No. 63-238225(1988), and so forth. The crystal habits are also allowed to have any mixtures of the (111) and (100) faces of a cube, tetradecahedron, octahedron and the intermediates thereof.

The crystals of silver halide are also allowed to have the different silver halide compositions between the inside and the outside thereof. The preferable embodiments of emulsions include, for example, a core/shell type monodisperse emulsion having a two-layered structure comprising a high iodine-containing core and a low iodine-containing shell. The silver iodide content of the high iodine-containing portion is to be within the range of 20 to 40 mol % and, preferably, 20 to 30 mol %. The examples of these emulsions are described in, for example, J.Phot. Sci., No.12, pp.242–251, (1963); JP OPI Publication Nos. 48-36890(1973), 52-16364(1977), 55-142329(1980) and 58-49938(1983); British Pat. No. 1,413,748; U.S. Pat. Nos. 3,574,628, 3,655,394; British Patent No. 1,027,146; U.S. Pat. Nos. 3,505,068 and 4,444,877; JP OPI Publication No. 60-14331(1985); and so forth.

Another silver halide emulsion also preferably applicable to the invention is a tabular-shaped grain having an average aspect ratio higher than 1. These tabular-shaped grains are disclosed in, for example, British patent No. 2,112,157, U.S. Pat. Nos. 4,439,520, 4,433,048, 4,414,310 and 4,434,226, JP OPI Publication Nos. 58-113927(1983), 58-127921(1983, 63-138342(1988), 63-284272(1988) and 63-305343(1988), and so forth. Each of the disclosures expressly states that the advantages of these tabular-shaped grains are that the spectral sensitization efficiency, image graininess and image sharpness can be improved. These emulsions may be prepared in the processes described in the above-given disclosures.

Particularly, the preparation processes preferably applicable include those described in, for example, JP Application No. 4-289002(1992) (See pp.1–3), JP OPI Publication No. 59-177535(1984) (See pp.2–5), JP Application No. 4-277369(1992) (See pp.5–6), and JP OPI Publication No. 62-42146 (1987) (See pp.14–15).

A further silver halide emulsion preferably applicable to the invention include those of silver chlorobromide or silver chloride each having a silver chloride content of not less than 50%.

The above-mentioned emulsion may be any one of the surface latent image type for forming a latent image on the surface thereof, an internal latent image type for forming a latent image in the inside thereof and the type for forming latent images each on the surface and inside thereof. In the course of physically ripening or preparing the grains of these emulsions, they may be applied with cadmium salt, lead salt, zinc salt, thallium salt, iridium salt or the complex salts thereof, rhodium salt or the complex salts thereof, iron salt or the complex salts thereof, or the like. These emulsions may be subject to a washing treatment such as a noodle washing or flocculation-precipitation treatment so that a soluble salt may be removed. The preferable washing treatments, that is, the preferable desairing treatments include, for example, a treatment cited in JP Examined Publication No. 35-16086(1960) in which aromatic hydrocarbon type aldehyde resin containing a sulfo group is used, or a treatment cited in JP OPI Publication No. 63-158644(1988) in which the flocculation high polymers exemplified therein as G3 and G8 and so forth are used. The processes for chemically ripening an emulsion preferably applicable to a light-sensitive material of the invention include, for example, a gold sensitization, a sulfur sensitization, a reduction sensitization, a sensitization to be made with a chalcogen compound, and the combination thereof.

To the emulsions of a light-sensitive material applicable to the invention, a variety of photographic additives may be applied before or after carrying out a physical or chemical ripening step. A hydrazine compound may also be added thereto. The compounds given in JP Application No. 5-134743(1993) are preferable. Particularly, the compounds represented by Formula (5) are preferable, and the compounds represented by Formulas (7) and (8) are preferable for a nucleation accelerator. A tetrazolium salt may also be added thereto and those given in JP OPI Publication No. 2-250050(1990) are particularly preferable. Besides the above, the other well-known additives include, for example, the compounds given in Research Disclosure No. 17643 (Dec., 1978), ibid., No. 18716 (Nov., 1979) and, ibid., No. 308119 (Dec., 1989). The kinds of the compounds given in the above three Research disclosures and the pages they appeared will be shown in the following table.

| | RD-17643 | | RD-18716 | | RD-308119 | |
|---|---|---|---|---|---|---|
| Additive | Page | Class | Page | Class | Page | Class |
| Chemical sensitizer | 23 | III | 648 | upper right | 996 | III |
| Sensitizing dye | 23 | IV | 648–649 | | 996–8 | IV |
| Desensitizing dye | 23 | IV | | | 998 | B |
| Dye | 25–26 | VIII | 649–650 | | 1003 | VIII |
| Development accelerator | 29 | XXI | 648 | upper right | | |
| Antifoggant.Stabilizer | 24 | IV | 649 | upper right | 1006–7 | VI |
| Whitening agent | 24 | V | | | 998 | V |
| Layer hardener | 26 | X | 651 | left | 1004–5 | X |
| Surfactant | 26–7 | XI | 650 | right | 1005–6 | XI |
| Antistatic agent | 27 | XII | 650 | right | 1006–7 | XIII |
| Plasticizer | 27 | XII | 650 | right | 1006 | XII |
| Lubricant | 27 | XII | | | | |
| Matting agent | 28 | XVI | 650 | right | 1008–9 | XVI |
| Binder | 26 | XXII | | | 1003–4 | IX |
| Support | 28 | XVII | | | 1009 | XVII |

A support applicable to a light-sensitive material relating to the invention include, for example, those given in the foregoing RD-17643, p.28 and RD-308119, p.1009.

The suitable supports include, for example, a plastic film. The surface of the support may be provided with a subbed layer and/or treated with a corona-discharge, UV irradiation or the like, so that the adhesion property of the resulting coated layer can be improved. Further, a cross-overcut layer and/or an antistatic layer may also be provided thereto.

An emulsion layer may be made present on both sides or one side only of a support. When the layers are on the both sides, the both sides may have the same or different characteristics.

EXAMPLES

Now, the invention will be detailed with the citation of the following examples. However, the embodiments of the invention shall not be limited thereto.

Example 1

First, a light-sensitive material for evaluation purpose was prepared in the following manner.

Preparation of light-sensitive material
Preparation of Seed Emulsion-1
Seed emulsion-1 was prepared in the following manner.

| | | |
|---|---|---|
| A1 | Ossein gelatin | 24.2 g |
| | Water | 9657 ml |
| | Sodium polypropyleneoxy-polyethyleneoxy-disuccinate (in an aqueous 10% ethanol solution) | 6.78 ml |
| | Potassium bromide | 10.8 g |
| | 10% nitric acid solution | 114 ml |
| B1 | Aqueous 2.5N silver nitrate solution | 2825 ml |
| C1 | Potassium bromide | 841 g |
| | Add water to make | 2825 ml |
| D1 | An aqueous 1.75N potassium bromide solution | An amount for controlling the following silver potential |

To Solution A1, Solutions B1 and C1 were each added in an amount of 464.3 ml at 42° C. by making use of a mixing stirrer shown in JP Examined Publication Nos. 58-58288(1983) and 58 -58289(1983) in a double-jet process by taking 1.5 minutes, so that nucleus grains were formed.

After stopping the addition of Solutions B1 and C1, the temperature of Solution A1 was raised to 60° C. by taking 60 minutes and the pH thereof was adjusted to be 5.0 by making use of a 3% KOH solution. Thereafter, Solutions B1 and C1 were each added thereto again at a flow rate of 55.4 ml/min. for 42 minutes in the double-jet process. At the time for raising the temperature from 42° C. to 60° C. and the time for the subsequent double-jet process carried out with Solutions B1 and C1, the silver potential (measured by a silver-ion selection electrode together with a saturated silver-silver chloride electrode as a control electrode) was so controlled as to be +8 mv and +16 mv by making use of Solution D1, respectively.

After the completion of the addition, the pH was adjusted to be 6 with a 3% KOH solution and a desairing treatment were immediately made. The resulting seed emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.064 μm and 0.595 μm, respectively. Further, the variation coefficients of the grain thickness and the distance between the twin planes thereof were proved to be and 42%, respectively.

Preparation of Em-1

By making use of Seed emulsion-1 and the following 4 kinds of solutions, tabular-shaped silver halide emulsion Em-1 was prepared.

| | | |
|---|---|---|
| A2 | Ossein gelatin | 34.03 g |
| | Sodium polypropyleneoxy-polyethyleneoxy-disuccinate (in an aqueous 10% ethanol solution) | 2.25 ml |
| | Seed emulsion-1 | Equivalent to 1.218 mols |
| | Add water to make | 3150 ml |
| B2 | Potassium bromide | 1734 g |
| | Add water to make | 3644 ml |
| C2 | Silver nitrate | 2478 g |
| | Add water to make | 4165 ml |
| D2 | A fine-grained emulsion* comprising 3 wt % of gelatin and silver iodide grains (having an average grain-size of 0.05 μ) | Equivalent to 0.080 mols |

*To 6.64 liters of an aqueous 5.0 wt % gelatin solution containing 0.06 mols of potassium iodide, 2 liters each of an aqueous solution containing 7.06 mols of silver nitrate and an aqueous solution containing 7.06 mols of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

In a reaction chamber, Solution A2 was violently stirred with keeping the temperature at 60° C. Thereto a part of Solution B2, a part of Solution C2 and the half amount of Solution D2 were each added in a triple-jet process by taking 5 minutes. Thereafter, the half amounts each of the remaining Solutions B2 and C2 were added successively by taking 37 minutes and, finally, the whole remaining amount of Solutions B2 and C2 were each added by taking 33 minutes. In the above-mentioned courses, the pH and pAg thereof were kept at 5.8 and 8.8 for all the while. Wherein, the adding rates of Solutions B2 and C2 were acceleratedly varied so as to meet the critical growth rate.

Further, the above-mentioned Solution D2 was added in an amount equivalent to 0.15 mol % of the whole silver amount, so that a halogen conversion was performed.

After completing the additions, the resulting emulsion was cooled down to 40° C. and, thereto, 1800 ml of an aqueous solution of 13.8 wt % of gelatin modified with a phenylcarbamoyl group (substitution ratio of 90%), was added as a polymeric flocculant. The resulting emulsion was then stirred for 3 minutes. Thereafter, an aqueous 56 wt % of acetic acid solution was added thereto. The pH of the emulsion was adjusted to be 4.6. The emulsion was stirred for 3 minutes and was then allowed to stand for 20 minutes. The resulting supernatant was removed away by means of a decantation. Then, 9.0 liters of distilled water having a temperature of 40° C. was added. After stirring and then allowing it to stand, the resulting supernatant was removed away and 11.25 liters of distilled water was further added thereto. After stirring and allowing it to stand, the resulting supernatant was removed away. Successively, an aqueous gelatin solution and an aqueous 10 wt % sodium carbonate solution were added and the pH thereof was adjusted to be 5.80. The resulting solution was stirred at 50° C. for 30 minutes and was then redispersed. After completing the redispersion, the pH and pAg thereof were adjusted at 40° C. to be 5.80 and 8.06, respectively.

When observing the resulting silver halide emulsion through an electron microscope, it was proved to be the tabular-shaped silver halide grains having the average grain-size of 1.11 μ, the average thickness of 0.25 μ, the average aspect ratio of about 4.5 and the grain-size distribution of 18.1%. The average distance between the twin planes of the grains was 0.020 μ. In the ratio of the distance between the twin planes to the grain thickness, the grains having not lower than 5 thereof were proved to account for 97% (in numbers) of the total tabular-shaped silver halide grains. Those having not less than 10 were proved to account for 49% of the total grains, and those having not less than 15 accounted for 17% thereof.

Next, the resulting emulsion (Em-1) raised to be 60° C. and a given amount of a spectral sensitization dye was added in the form of a solid fine-grain dispersion. After adding it, an aqueous mixed solution of adenine, ammonium thiocyanate, chloroauric acid and sodium thiosulfate and a dispersion of triphenyl phosphine selenide were added and, after 60 minutes, a silver iodide fine-grained emulsion was added. Then, a chemical-ripening treatment was carried out for two hours in total. At the time of completing the ripening treatment, a given amount of 4-hydroxy-6-methyl-1,3,3a,7-tetrazaindene (TAI) was added as a stabilizer.

The above-mentioned additives and the amount of them added (per mol of AgX) are shown below.

| | |
|---|---|
| Spectral sensitization dye (I) An anhydride of sodium 5,5'-di-(butoxycarbonyl)-1,1'-diethyl-3,3'-di-(4-sulfobutyl)-benzoimidazolocarbocyanine | 2.0 mg |
| Spectral sensitization dye (II) Anhydride of sodium 5,5'-dichloro-9-ethyl-3,3'-(3-sulfopropyl)-oxacarbocyanine | 120 mg |
| Adenine | 15 mg |
| Potassium thiocyanate | 95 mg |
| Chloroauric acid | 2.5 mg |
| Sodium thiosulfate | 2.0 mg |
| Triphenylphosphine selenide | 0.4 mg |
| Silver iodide fine grains | 280 mg |
| 4-hydroxy-6-methyl-1,3,3a,7-tetrazaindene (TAI) | 500 mg |

The solid, fine-grain, dispersion of the spectral sensitization dyes were each prepared in the process according to the process described in JP Application No. 4-99437(1992). To be more concrete, they were prepared in such a manner that a given amount of the spectral sensitization dye was added to water thermally controlled to be 27° C. and it was stirred at 3,500 rpm by making use of a high-speed dissolver for a period within the range of 30 to 120 minutes.

The dispersion of the above-mentioned selenium sensitizer was prepared in the following manner. Thus, 120 g of triphenylphosphine selenide was added to 30 kg of ethyl acetate kept at 50° C. and then so stirred as to be dissolved completely. On the other hand, 3.8 kg of photographic gelatin was dissolved in 38 kg of water and, thereto, an aqueous 25 wt % of sodium dodecylbenzene sulfonate was added. Next, these two solutions were mixed up and the resulting mixture was dispersed at 50° C. for 30 minutes by making use of a high-speed stirring disperser provided with a 10-cm dissolver at a dispersion blade speed of 40 m/sec. Thereafter, the remaining ethyl acetate was removed while a stirring was rapidly carried out under reduced pressure so that the ethyl acetate concentration could be not higher than 0.3 wt %. Then, the resulting dispersion was diluted by making use of pure water so as to make 80 kg. A part of the resulting dispersion was fractionally extracted so as to use for the above-mentioned experiment.

In the silver halide grains contained in silver halide emulsion (Em-1), the average iodine content on the outermost surface thereof was proved to be about 4 mol %.

Next, an emulsion layer coating solution was prepared by adding the later-mentioned additives to the chemically-ripened emulsion in the following manner. At the same time, a protective layer coating solution was also prepared.

Next, On the both sides of a support prepared by coating the following cross-over-light shielding layers in advance on the both sides of a polyethylene terephthalate film for X-ray use (having a thickness of 175 μm) that was blue-tinted with a density of 0.15, the foregoing emulsion layer coating solution and protective layer coating solution were simultaneously multi-layer-coated in order from the support base so as to coat the following given coating weight thereon; and the resulting coated support was then dried up.

| | |
|---|---|
| Layer 1 (a cross-overlight shielding layer) | |
| Solid fine-grain dispersion of dye (AH) | 180 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (having an average particle-size of 0.014 μm) | 10 mg/m$^2$ |
| Layer 2 (an emulsion layer) | |
| The following additives were added to each of the emulsions prepared in the above-mentioned manner. | |
| Compound (G) | 0.5 mg/m$^2$ |
| 2,6-bis(hydroxyamino)-4-diethylamino-1,3,5-triazine | 5 mg/m$^2$ |
| t-butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Sodium polystyrene sulfonate | 80 mg/m$^2$ |
| Trimethylol propane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| $n\text{-}C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica | 0.5 g/m$^2$ |
| Latex (L) | 0.2 g/m$^2$ |
| Dextrin (having an average molecular weight of 1000) | 0.2 g/m$^2$ |
| Gelatin was adjusted to be in an amount of | 1.0 g/m$^2$ |
| Layer 3 (a protective layer) | |
| Gelatin | 0.8 g/m$^2$ |
| A matting agent comprising polymethyl methacrylate (having an area average particle-size of 7.0 μM) | 50 mg/m$^2$ |
| Formaldehyde | 20 mg/m$^2$ |
| Sodium 2,4-dichloro-6-hydroxy-1,3,5-triazine | 10 mg/m$^2$ |
| Bis-vinylsulfonylmethyl ether | 36 mg/m$^2$ |
| Latex (L) | 0.2 g/m$^2$ |
| Polyacrylamide (having an average molecular weight of 10000) | 0.1 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}\text{-}O\text{-}(CH_2CH_2O)_{11}\text{-}H$ | 3 mg/m$^2$ |
| $C_8F_{17}SO_2(C_3H_7)N_2\text{-}(CH_2CH_2O)_{15}H$ | 2 mg/m$^2$ |
| $C_8F_{17}SO_2N\text{-}(CH_2CH_2O)_4\text{-}(CH_2)_4SO_3Na$ | 1 mg/m$^2$ |

The amounts of the raw materials provided were for one side use, and the amounts of silver provided were each adjusted to be 1.6 g/m$^2$ for one side use.

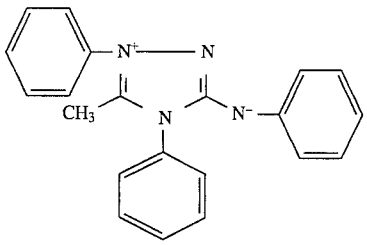

Compound (G)

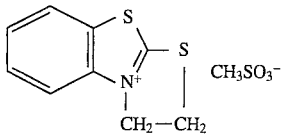

Compound (H)

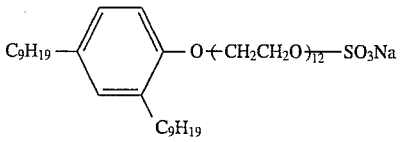

Compound (I)

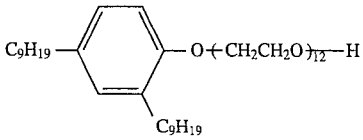

Compound (J)

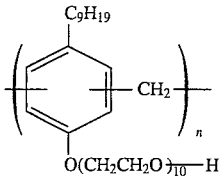

(mixture of n = 2 – 5)

Compound (K)

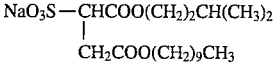

Compound (S-1)

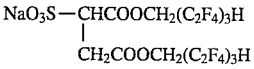

Compound (S-2)

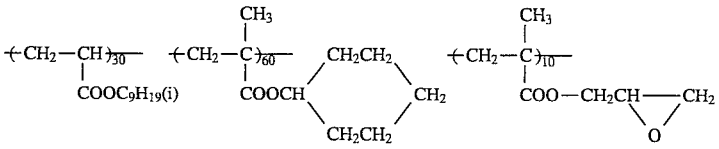

Latex (L)

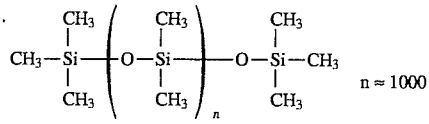

n ≈ 1000

Polysiloxane (SI)

Solid fine grain dispersion

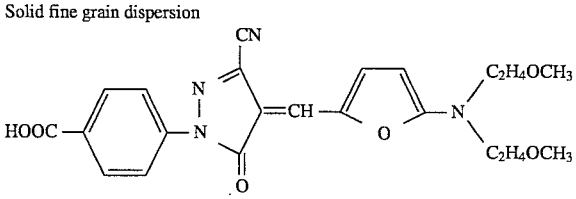

Dye (AH):

$C_{11}H_{23}CONH(CH_2CH_2O)_5H$

Compound (O)

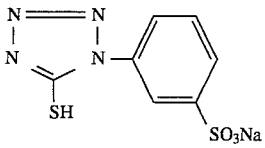

Compound (M)

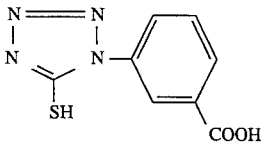

Compound (N)

A tablet for developer-replenishment use was prepared in accordance with the following procedures (A and B)

Procedures A

A developing agent, 3000 g of hydroquinone, was pulverized up in a mill so as to have an average particle-size of 10 μm. To the resulting fine particles, 3000 g of sodium sulfite, 2000 g of potassium sulfite and 1000 g of Dimeson S were added and the mixed up in a mill for 30 minutes. In a stirring granulator available on the market, the resulting mixture was granulated for about 10 minutes at room temperature by adding 30 ml of water. The resulting granules were dried up at 40° C. for 2 hours in a moving-bed drier so that the moisture content of the granules was almost completely removed off. In a room controlled to be not higher than 25° C. and 40% RH and by making use of a mixer, 100 g of polyethylene glycol 6000 was uniformly mixed with the granules prepared as mentioned above for 10 minutes, and the resulting mixture was compression-tableted so as to have the filling amount of 3.64 g per tablet, by making use of a tableting machine that was a modified model of Tough Pressed Collect 1527HU manufactured by Kikusui Mfg. Works, Inc. Thereby, 2500 pieces of tablet A for developer replenishment use were prepared.

Procedures B

One hundred grams of DTPA, 4000 g of potassium carbonate, 10 g of 5-methylbenzotriazole, 7 g of 1-phenyl-5-mercaptotetrazole, 5 g of 2-mercaptohypoxanthin, 200 g of KOH and N-acetyl-D,L-penicillamine were pulverized and granulated in the same manner as in Procedures (A). Amount of water added was 300 ml. After completion of the granulation, the resulting granules were dried at 50° C. for 30 minutes, so that the moisture content of the granules was almost completely removed off. The mixture prepared in this manner was compression-tableted so that the filling amount per tablet could be 1.73 g per tablet, by making use of a tableting machine that was a modified model of Tough Pressed Collect 1527HU manufactured by Kikusui Mfg. Works, Inc. Thereby 2500 pieces of Tablet B for developer replenishment use were prepared.

A tablet for fixer replenishment use was prepared in the following manner.

Procedures C

Ammonium thiosulfate/sodium thiosulfate (having a weight ratio of 70/30) of 14000 g and 1500 g of sodium sulfite were pulverized in the same manner as in Procedures (A) and were then uniformly mixed up together by making use of a mixer available on the market. In the same manner as in Procedures (A), the granulation was then made by adding 500 ml of water. After completion of the granulation, the resulting granules were dried at 60° C. for 30 minutes, so that the moisture content of the granules was almost completely removed off. Four grams of sodium N-lauroylalanine was added to the resulting granules and, in a room controlled to be not higher than 25° C. and 40% RH, they were mixed for 3 minutes by making use of a mixer. Next, the resulting mixture was compression-tableted so that the filling amount could be 6.202 g per tablet, by making use of a tableting machine that was a modified model of Tough Pressed Collect 1527HU manufactured by Kikusui Mfg. Works, Inc. Thereby 2500 pieces of Tablet C for fixer replenishment use were prepared.

Procedures D

One thousand grams of boric acid, 1500 g of aluminum sulfate octadeca hydride, 3000 g of sodium hydrogen acetate (prepared by mixing glacial acetic acid and 200 g of tartaric acid were pulverized and granulated in the same manner as in Procedures (A). The amount of water added was 100 ml. After completion of the granulation, the resulting granules were dried at 50° C. for 30 minutes and the moisture content of the granules was almost completely removed off. Four grams of sodium N-lauroyl alanine was added to the granules prepared in this manner and they were mixed together for 3 minutes. Thereafter, the resulting mixture was compression-tableted so as to have a filling amount of 4.562 g per tablet, by making use of a tableting machine that was a modified model of Tough Pressed Collect 1527HU manufactured by Kikusui Mfg. Works, Inc. Thereby 1250 pieces of Tablet D for fixer replenishment use were prepared.

| Developer starter | |
|---|---|
| Glacial acetic acid | 2.98 g |
| KBr | 4.0 g |
| Add water to make | 1 liter |

At the start of processing, a developer solution prepared by adding 330 ml of a starter to 16.5 liters of a developer prepared by dissolving developer tablets in water, and thus prepared developer solution was filled up, as a starting developer, in a developing tank. Similarly, a fixing tank was also made ready to be the starting conditions. The replenishing solutions were filled in one each of developer-replenishing tanks and fixer-replenishing tanks, respectively. Then, the processing was started. The pH of the starting developer solution was 10.45.

The photographic light-sensitive material was exposed to light so that the optical density after developing could be 1.0, and 100 sheets each of 10×12-inch sized photographic material were running processed daily successively for 30 days. In the running-processing, there was used an automatic processor modified Model SRX-502 (manufactured by Konica Corp) modified, in which solid processing composition-inputting members and two each of developer- and fixer-replenishing tanks having 2-liter-capacity were provided and further was provided a connecting line between each of the replenishing tanks and each of the processing tanks (developing and fixing tanks), respectively. The total processing time was 25 seconds.

In the course of a running process, while replenishment from one of the replenishing tanks to the developing tank was made at a rate of 80 ml of the replenishing solution per 0.62 $m^2$ of the photographic material. The developer tablets A and B and water were added to another developer-replenishing tank in a proportion of two pieces each of the tablets and 76 ml of water per 0.62 $m^2$ of the photographic material. When the tablets A and B were each dissolved in 38 ml of water, the pH thereof was 10.70. While replenishment was made from one of the replenishing tanks to a fixing tank in an amount of 80 ml per 0.62 $m^2$ of the photographic material, to another fixer-replenishing tank, were added the fixer tablets in a proportion of two pieces of the tablet C, one piece of tablet D and 74 ml of water each per 0.62 $m^2$ of the photographic material. Water-addition was started almost at the same time when the processing composition tablets was added and it was added for 10 minutes at the constant rate in almost proportion to the replenishing rate of the processing composition. At that time, the dissolution was made by circulating the solution at a rate of 15 liters/min. by making use of a circulation pump. The replenishing time was 7.5 min. in the developer-replenishing tank and 5.0 min. in one fixer-replenishing tank.

Processing was carried out in accordance With the following steps

| Processing conditions | | |
|---|---|---|
| Developing | 35° C. | 8.2 sec. |
| Fixing | 33° C. | 5 sec. |
| Washing | at an ordinary temperature | 4.5 sec. |
| Squeezing | | 1.6 sec. |
| Drying | 40° C. | 5.7 sec. |
| | | Total: 29 sec. |

Comparative processing

According the following formulas, developer- and fixer-replenishing solution were prepared.

| Developer: | |
|---|---|
| Potassium carbonate | 40 g |
| Hydroquinone | 30 g |
| Dimeson S | 10 g |
| Diethylenetriamine pentaacetic acid · 5Na (DTPA) | 1 g |
| Potassium bromide | 2 g |

-continued

| Developer: | |
|---|---|
| 5-methyl benzotriazole | 0.1 g |
| 1-phenyl-5-mercaptotetrazole | 0.07 g |
| 2-mercaptohypoxanthin | 0.05 g |
| Sodium sulfite | 30 g |
| Potassium sulfite | 25 g |
| KOH | 2 g |
| Diethylene glycol | 50 g |
| N-acetyl-D,L-penicillamine | 0.1 g |

The above developer chemicals were dissolved in 300 ml of water and water was further added to make 400 ml. The resulting concentrated solution was diluted with water to make one liter so as to serve as a replenishing solution. The pH thereof was 10.70. The replenishing solution was made in an amount of 48 liters, which were put into a developer replenishing tank, Chemical Mixer, Model CM-50 manufactured by Konica Corp.

| Fixer: | |
|---|---|
| Sodium thiosulfate | 42.0 g |
| Potassium thiosulfate | 98.0 g |
| Sodium sulfite | 15.0 g |
| Boric acid | 10.0 g |
| Sodium hydrogen acetate | 30.0 g |
| Glacial acetic acid | 17.3 g |
| Sodium acetate | 12.7 g |
| Tartaric acid | 2.0 g |

The above fixer chemicals were dissolved in 400 ml of water and water was further added to make 500 ml. The resulting concentrated solution was diluted with water to make one liter so as to serve as a replenishing solution. The pH thereof was 4.50. The replenishing solution was made in an amount of 45 liters, which were put into a fixer-replenishing tank, a Chemical Mixer, Model CM-50 manufactured by Konica Corp.

The photographic material was exposed and processed, using the processor (Model SRX-502), in a similar manner as afore-described, provided that replenishments of the developer and fixer each were made directly from the afore-described developer-replenishing tank (CM-50) and fixer-replenishing tank (CM-50), which were each located near the processor, to the developing and fixing tanks of the processor at the same rate as afore-described (80 ml/0.62 $m^2$).

When starting the processing the same starter as aforementioned was added to the developer and then the processing was started.

Evaluation on processing stability

The following samples prepared were sensitometrically tested every day in each of the above-mentioned processing procedures, and the processing variations thereof were evaluated. The results thereof are shown in Table 1.

(Sensitometry)

A photographic material sample was sandwiched between fluorecent X-ray intensifying screens SR0-250 (manufactured by Konica Corp.) and was exposed to X-rays with a tube voltage of 90 KVP for 0.05 seconds, and a sensitometric curve was made out in a distance range method, so that the resulting fog, sensitivity and Gamma (an average gradation between a fog+0.25 and the fog+2.0) were obtained. The sensitivity value was obtained as the reciprocal of an X-ray dose required for producing a density of a fog+1.0, and the sensitivity values obtained were indicated by a value relative to the sensitivity obtained at the start of the processing, that was regarded as 100.

TABLE 1

| | | At the start | 5th day | 10th day | 15th day | 20th day | 25th day | 30th day |
|---|---|---|---|---|---|---|---|---|
| Inventive processing | Fog | 0.020 | 0.020 | 0.020 | 0.018 | 0.018 | 0.017 | 0.018 |
| | Sensitivity | 100 | 100 | 100 | 98 | 98 | 100 | 98 |
| | Gamma | 2.60 | 2.61 | 2.59 | 2.58 | 2.59 | 2.60 | 2.59 |
| Comparative processing | Fog | 0.020 | 0.020 | 0.019 | 0.018 | 0.017 | 0.017 | 0.016 |
| | Sensitivity | 100 | 100 | 95 | 92 | 87 | 84 | 80 |
| | Gamma | 2.60 | 2.58 | 2.55 | 2.52 | 2.45 | 2.40 | 2.30 |

From the results shown in Table 1, it was proved that the processing of the invention achieved less running-variation in fog, sensitivity and gamma, and stable photographic characteristics, as compared to the comparative processing. In the comparative processing, wherein a large amount of a replenishing solution was prepared at a time, which was replenished to a processing tank, exhaustion of the replenishing solution remarkably proceeds with the increase of the processing days, resulting in the deterioration of the photographic characteristics such sensitivity, fog and gamma.

Example 2

Preparation of an emulsion

While controlling the temperature to be 60° C., the pAg to be 8 and the pH to be 2.0 and in a double-jet process, silver iodobromide monodispersed cubic crystal emulsion was so prepared as to contain 2 mol % of silver iodide and have an average grain-size of 0.13 μm. From the electron microscopic photograph of the resulting emulsion grains, it was proved that the twinned crystal grain production ratio was not more than 1% in number.

By making use of the resulting emulsion as the seed crystals, they were grown up in the following manner.

The seed crystals were dispersed in a 8.5 l gelatin solution kept at 40° C. and containing ammonia, if required. The pH of the solution was adjusted with acetic acid.

By making use of the resulting solution as a mother liquor, a 3.2N ammoniacal silver nitrate solution, an aqueous potassium bromide and potassium iodide solution were added thereto.

Thus, the pAg and pH of the reaction mixture were controlled to be 7.3 and 9.7, respectively, so that a layer having a silver iodide content of 35 mol % was formed. Next, after the pH thereof was varied to be within the range of 9.0 to 8.0 and the pAg thereof was then kept at 9.0, an ammoniacal silver nitrate solution and a potassium bromide solution were added thereto, so that silver halide grains were grown up. In the course of growing them, a potassium bromide solution was added through a nozzle by taking 8 minutes and the pAg was lowered to be 11.0, so that the mixing was further continued for 3 minutes after completion of the addition of the potassium bromide. The resulting emulsion was proved to be the tetradecahedral monodispersed grain emulsion having an average grain-size of about 0.3 μm and the rounded peaks. The average overall silver iodide content of the grains was 1.5 mol %.

Then, a desairing treatment was carried out for removing an excess soluble salt contained in the resulting reaction mixture. To be more concrete, the reaction mixture was kept at 40° C., and a formaldehyde condensate of sodium naphthalene sulfonate and magnesium sulfate were added thereto. The solution was stirred and allowed to stand, so that the excess salts were removed in a decantation process.

Next, the desalted emulsion was kept at 55° C. and ammonium thiocyanate, chloroauric acid and sodium thiosulfate were added thereto to perform chemical sensitization. Then, the following compounds I-1 and II-1 were each added in an amount of 20 mg per mol of silver halide, so that the resulting emulsion was spectrally sensitized. At an optimal point of time, 4-hydroxy-6-methyl-1,3,3a,7-tetrazaindene was added in an amount of 1.2 g per mol of silver halide to stabilize the emulsion. The resulting emulsion was used as an emulsion coating solution.

To the emulsion coating solution, the following additives were added per mol of silver halide, respectively.

| | |
|---|---|
| Nitrophenyl-triphenyl phosphonium chloride | 30 mg |
| Ammonium 1,3-dihydroxybenzene-4-sulfonate | 1 g |
| Sodium 2-mercaptobenzimidazole-5-sulfonate | 10 mg |
| 2-mercaptobenzothiazole | 10 mg |
| Trimethylol propane | 9 g |
| 1,1-dimethylol-1-bromo-1-nitromethane | 10 mg |
| $C_4H_9OCH_2CH(OH)CH_2N(CH_2COOH)_2$ | 1 g |

I-1

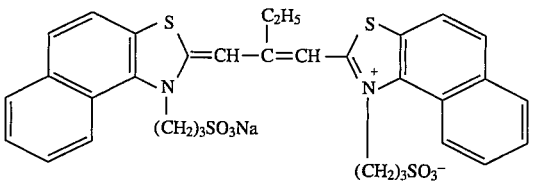

II-1

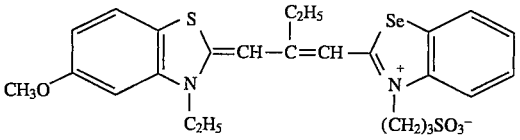

The protective layer coating solution had the following components. The amount of the components added is indicated by an amount per liter of the coating solution.

| | |
|---|---|
| Lime-treated inert gelatin | 85.5 g |
| Acid-treated gelatin | 2 g |
| Sodium salt of α-sulfosuccinic acid | 0.3 g |

-continued

| | |
|---|---|
| didecyl ester | |
| Polymethyl methacrylate (having an area average particle-size of 4 μm) | 3.5 g |
| Silicon dioxide (a matting agent having an area average particle-size of 1.2 μm) | 0.5 g |
| Rudox AM (colloidal silica manufactured by DuPont) | 30 g |
| An aqueous solution of 2% sodium salt of 2,4-dichloro-6-hydroxy-1,3,5-triazine (a layer hardener) | 10 ml |
| An aqueous 35% formalin solution (a layer hardener) | 2 ml |
| An aqueous 40% glyoxal solution (a layer hardener) | 1.5 ml |

There prepared a backing layer solution comprising 2 g/m$^2$ equivalent amount of a dye-emulsified dispersed matter comprising 400 g of gelatin, 2 g of polymethyl methacrylate, g of potassium nitrate, 6 g of sodium dodecylbenzene sulfonate and 20 g of the following antihalation dye-1, and glyoxal. A polyethylene terephthalate base was coated thereon with a copolymeric aqueous dispersed matter prepared, as a subbing solution, by diluting a glycidyl methacrylate-methyl acrylate-butyl methacrylate copolymer (having a proportion of 50:10:40) so that the concentration thereof could be 10 wt %. On one side of the resulting coated base, the backing layer coating solution together with a protective layer coating solution comprising gelatin, a matting agent, glyoxal and sodium dodecylbenzene sulfonate were coated, so that a back-coated support could be prepared.

By making use of a slide-hopper coating, the above-mentioned emulsion coating solution and the protective layer coating solution were simultaneously double layer-coated on the base, under the conditions that the amount of gelatin coated was 2.4 g/m$^2$ and the amount of silver provided was 2.1 g/m$^2$, so that a photographic film was prepared.

By making use of the resulting photographic material, the evaluations were made in the same manner as in Example 1.

<Sensitometry>

The photographic material was exposed to a semiconductor laser light having a wavelength of 670 nm and processed in a similar manner to Example 1. According to the procedure in Example 1, the evaluation was made.

The results thereof are shown in Table 2.

TABLE 2

| | | At the start | 5th day | 10th day | 15th day | 20th day | 25th day | 30th day |
|---|---|---|---|---|---|---|---|---|
| Inventive processing | Fog | 0.015 | 0.015 | 0.014 | 0.014 | 0.014 | 0.014 | 0.014 |
| | Sensitivity | 100 | 102 | 100 | 98 | 98 | 100 | 98 |
| | Gamma | 3.40 | 3.42 | 3.38 | 3.38 | 3.36 | 3.38 | 3.38 |
| Comparative processing | Fog | 0.015 | 0.015 | 0.014 | 0.014 | 0.015 | 0.013 | 0.014 |
| | Sensitivity | 100 | 98 | 95 | 91 | 86 | 82 | 78 |
| | Gamma | 3.40 | 3.38 | 3.32 | 3.28 | 3.21 | 3.12 | 3.03 |

Even when making use of the above-mentioned photographic material, the same results were obtained as in Example 1.

Example 3

An electric heater was provided to each of the developer-replenishing tanks and fixer-replenishing tanks of the automatic processor used in Example 1, so that the solution temperature was raised up to 30° C. when replenishing the solid processing composition. The composition replenishing time was 6.0 minutes of the developer-replenishing tanks, or 4.0 minutes in the fixer-replenishing tanks. The replenishing times thereof were each shortened as compared to those in Example 1.

Example 4

Preparation of silver halide emulsion B

When mixing up, rhodium hexachloride complex was added, in a double-jet process, in an amount of $8\times10^5$ mols per mol of silver and the resulting emulsion was desalted in a conventional manner. Then, there obtained an emulsion comprising monodispersed cubic grains (having a variation coefficient of 10%) of silver chlorobromide (comprising 99 mol % of silver chloride and silver bromide for the rest) having an average grain-size of 0.10 μm.

To the resulting emulsion, potassium bromide and citric acid were added and then inorganic sulfur was further added in an amount of $3\times10^{-6}$ mols per mol of silver. A chemical ripening treatment was optimally carried out at 60° C. After the completion of the ripening treatment, 4-hydroxy-6-methyl-1,3,3 a,7-tetrazaindene, 1-phenyl-5-mercaptotetrazole in an amount of $3\times10^{-4}$ mols and gelatin were added thereto.

Preparation of a silver halide photographic light-sensitive material

On the sublayer on one side of a 75 μm-thick polyethylene terephthalate film base subjected to the antistatic treatment described in Example 1 given in JP OPI Publication No. 3-92175(1991), a simultaneous multi-layer coating was applied thereon in the following manner. A gelatin sublayer having the following Formula 7 was coated on the base so that the gelatin content was 0.5 g/m$^2$; a silver halide emulsion having the following Formula 8 was simultaneously coated further thereon so that the silver content and the gelatin content were 2.5 g/m$^2$ and 1.0 g/m$^2$ respectively; and the coating solution having the following Formula 9 was simultaneously coated still further thereon so that the gelatin content was 0.4 g/m$^2$. On the opposite side sublayer, the backing layer having the following Formula 10 was coated so that the gelatin content was 0.4 g/m$^2$; and the polymer layer having the following Formula 11 was simultaneously coated; and still further thereon, the backing protective layer having the following Formula 12 was simultaneously coated so that the gelatin content was 0.4 g/m$^2$, respectively.

| Composition of gelatin-subbed layer | |
|---|---|
| Gelatin | 0.5 g/m$^2$ |
| Dye b (powdered to have a particle-size of 0.01 μm by a ball mill) | 20 mg/m$^2$ |
| Dye c (powdered to have a particle-size of 0.01 μm by a ball mill) | 10 mg/m$^2$ |
| Dye i (powdered to have a particle-size of 0.01 μm by a ball mill) | 80 mg/m$^2$ |
| A hydrophilic polymer of a styrene-maleic acid copolymer (a thickener) | 10 mg/m$^2$ |
| S-1 (sodium iso-amyl-n-decylsulfo-succinate) | 0.4 mg/m$^2$ |
| **Composition of silver halide emulsion** | |
| A tetrazolium compound | 30 mg/m$^2$ |
| Sodium dodecylbenzene sulfonate | 10 mg/m$^2$ |
| 5-methylbenzotriazole | 10 mg/m$^2$ |
| Compound m | 6 mg/m$^2$ |
| Latex polymer f | 1.0 g/m$^2$ |
| Layer hardener g | 40 mg/m$^2$ |
| S-1 | 0.7 mg/m$^2$ |

-continued

| | |
|---|---|
| A hydrophilic polymer of a styrene-maleic acid copolymer (a thickener) | 20 mg/m$^2$ |
| **Composition of emulsion protective layer** | |
| Gelatin | 0.5 g/m$^2$ |
| Dye c (powdered to have a particle-size of 0.01 μm by a ball mill) | 100 mg/m$^2$ |
| S-1 | 12 mg/m$^2$ |
| Matting agent (monodispersed silica having an average particle-size of 3.0 μm) | 15 mg/m$^2$ |
| Matting agent (monodispersed silica having an average particle-size of 8.0 μm) | 20 mg/m$^2$ |
| 1,3-vinyl sulfonyl-2-propanol | 50 mg/m$^2$ |
| Surfactant h | 1 mg/m$^2$ |
| Colloidal silica (having an average particle-size of 0.05 μm) | 20 mg/m$^2$ |
| **Composition of backing layer** | |
| Gelatin | 0.4 g/m$^2$ |
| S-1 | 5 mg/m$^2$ |
| Latex polymer f | 0.3 g/m$^2$ |
| Colloidal silica (having an average particle-size of 0.05 μm) | 70 mg/m$^2$ |
| A hydrophilic polymer of styrene-maleic acid copolymer (a thickener) | 20 mg/m$^2$ |
| Compound i | 100 mg/m$^2$ |
| **Composition of polymer layer** | |
| Latex n (styrene:butadiene:acrylic acid = 30:65:5) | 1.0 g/m$^2$ |
| Hardener g | 10 mg/m$^2$ |
| **Composition of backing layer** | |
| Gelatin | 0.4 g/m$^2$ |
| Matting agent (monodispersed polymethyl methacrylate having an average particle-size of 5 μm) | 50 mg/m$^2$ |
| Sodium di-(2-ethylhexyl)-sulfosuccinate | 10 mg/m$^2$ |
| Surfactant h | 1 mg/m$^2$ |
| $H-(OCH_2CH_2)_{68}-OH$ | 50 mg/m$^2$ |
| Layer hardener g | 40 mg/m$^2$ |

Compound 1

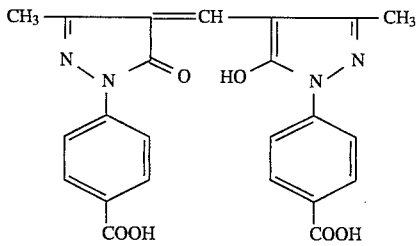

Compound m

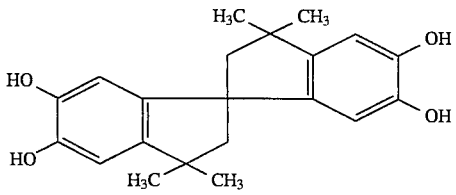

Latex polymer f

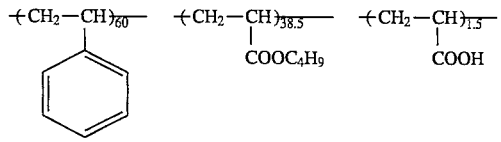

Layer hardener g

-continued

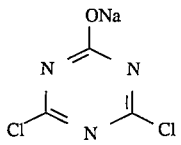

Surfactant h

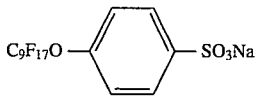

Dye b

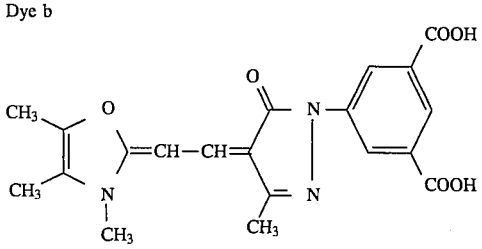

Dye c

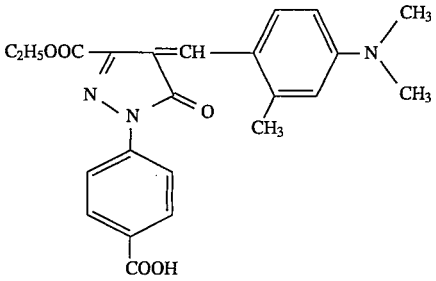

Dye i

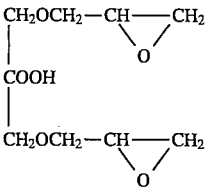

After roomlight-handling a contact printing film was exposed to light so that 20% of the overall are was developed sheets thereof were processed every day for 30 days in total. As for the automatic processor used therein, Model GR26SR (manufactured by Konica Corp.) was modified in a similar manner to Example 1, in which two replenishing tanks for developer were installed. The developing livid used in the tank when making a start will be indicated below. As a fixer starting solution and replenishing solution, CFL-881 (manufactured by Konica Corp.) was used.

According to the following procedures (A and B), a tablet for developer replenishment use was prepared.

Procedures (A)

A developing agent, 1400 g of hydroquinone, was pulverized in a mill available on the market so as to have an average particle-size of 10 μm. To the resulting fine particles, 1466 g of sodium sulfite, 3515 g of potassium sulfite and 140 g of Dimezone S were added and they were mixed in a mill for 30 minutes. The resulting mixture was granulated in a stirring granulator available on the market by adding 30 ml of water at room temperature for about 10 minutes. Then, the resulting granules were dried at 40° C. for 2 hours by making use of a moving-bed drier, so that the moisture of the granules was almost completely removed off. With the granules prepared in this manner, 100 g of polyethylene glycol 6000 was uniformly mixed up for 10 minutes in a room controlled to be not higher than 25° C. and 40% RH by making use of a mixer, and the resulting mixture was compression-tableted by a tableting machine that was a modified Tough Pressed Collect 1527HU manufactured by Kikusui Mfg. Works, Inc. so that the filling amount was 2.65 g per tablet. Thereby, 2500 pieces of Tablet A for developer replenishment use were prepared.

Procedures (B)

The pulverization and granulation of 100 g of EDTA·2Na, 250 g of potassium bromide, 4000 g of potassium carbonate, 50 g of 5-methylbenzotriazole, 2 g of 1-phenyl-5-mercaptotetrazole, 6 g of 2-mercaptohypoxanthin and 200 g of KOH were carried out in the same way as in Procedures (A). The amount of water added was 300 ml. After the granulation was completed, the granulates were dried at 50° C. for 30 minutes, so that the moisture thereof was almost completely removed off. The resulting mixture was compression-tableted by making use of a tableting machine that was a modified model of Tough Pressed Collect 1527HU manufactured by Kikusui Mfg. Works, Inc., so that the filling amount per tablet was 1.84 g. Thereby, 2500 pieces of Tablet B for developer replenishment use were prepared.

The developer-replenishing solution was prepared with keeping the addition of the above-mentioned tablets A and B, to a replenishing tanks, in an amount of two pieces each per 20×24-inch sheet in the course of processing, so that the running-processing was then carried out. Water was added to the replenishing tank in an amount of 37 ml sheet during the processing. The developer-replenishing solution was replenished in an amount of 40 ml per sheet, (called Processing A). As for the comparison, running processing was carried out by replenishing 13.32 ml of the the following concentrated developer and water in an amount of 26.68 ml per sheet, (called Processing B). When making use of the photographic material exposed ordinarily to light through a wedge, the sensitivity variations produced in the running processing were evaluated with respect to a decrease of sensitivity at the time after being running-processed for 30 days, as compared to that at the start of the processing. The results thereof are shown in Table 3.

TABLE 3

| | Decrease in sensitivity after 30 days running-processing |
|---|---|
| Inventive processing (Processing A) | 3% |
| Comparative processing (Processing B) | 40% |

As can be seen from the table, the inventive processing led to less decrease in sensitivity.

| Developer conc. solution (per liter of a developer) | |
|---|---|
| Water | 196 g |
| Potassium carbonate | 40 g |
| Hydroquinone | 14 g |
| Dimezone S | 1.4 g |
| EDTA · 2Na | 1.00 g |
| Potassium bromide | 2.5 g |
| 5-methylbenzotriazole | 0.50 g |
| 1-phenyl-5-mercaptotetrazole | 0.02 g |

-continued

| Developer conc. solution (per liter of a developer) | |
|---|---|
| 2-mercaptohypoxanthin | 0.06 g |
| Sodium sulfite | 14.66 g |
| Potassium sulfite | 35.15 g |
| KOH | 2 g |
| Diethylene glycol | 50 g |

Water was added to make 330 ml. The pH thereof was adjusted to be 10.70 with potassium hydroxide. The concentrated developer was so diluted 3 times with water to make 1 l, which was used as a starting developer solution.

| Processing steps | | |
|---|---|---|
| Developing | 35° C. | 15 sec. |
| Fixing | 33° C. | 10 sec. |
| Washing | at an ordinary temperature | 10 sec. |
| Drying | 40° C. | 10 sec. |

Example 5

A hydrazine derivative-containing photographic material as described in Example 2 of JP OPI Publication No. 5-241264(1993) was exposed to light so that 50% of the overall area thereof was developed, and 200 sheets thereof were processed every day for 30 days. As for the automatic processor for processing them, an automatic processor of LD220QT (manufactured by Dai-Nippon Screen Co.) modified similarly to Example 1, in which two developer-replenishing tanks were installed. The developer solution at the start of processing will be shown later. The fixer solution, FL-881 (manufactured by Konica Corp.), was used as a starting solution and a replenishing solution.

According to the following Procedures (A and B), a tablet for developer replenishment use was prepared.

Procedures (A)

A developing agent, 2000 g of hydroquinone, was pulverized in a mill available on the market so as to have an average particle-size of 10 μm. To the resulting fine particles, 4258 g of sodium sulfite, 1590 g of potassium sulfite, 85 g of Dimezone S and 800 g of boric acid were added and then mixed up in a mill for 30 minutes. The resulting mixture was granulated in a stirring granulator available on the market by adding 30 ml of water at room temperature by taking about 10 minutes. Thereafter, the resulting granules were dried at 40° C. for two hours by making use of a moving-bed drier so that the moisture of the granules was almost completely removed off. The granules prepared as mentioned above and 100 g of polyethylene glycol 6000 were uniformly mixed up for 10 minutes by making use of a mixer in a room controlled to be not higher than 25° C. and 40% RH. Then, the resulting mixture was compression-tableted by a tableting machine that was a modified Tough Pressed Collect 1527HU manufactured by Kikusui Mfg. Corks, Inc. so that the filling amount per tablet was 3.53 g. Thereby, 2500 pieces of Tablet A for developer replenishment use were prepared.

Procedures B

EDTA·2Na of 100 g, 500 g of potassium bromide, 20 g of 5-methylbenzotriazole, 3 g of 1-phenyl-5-mercaptotetrazole, 8 g of 2-mercaptohypoxanthin and 1000 g of KOH were pulverized and then granulated in the same manner as in Procedures (A). The amount water added was 300 ml. After completing the granulation, the resulting granules were dried at 50° C. for 30 minutes, so that the moisture of the granulates was almost completely removed off. The mixture prepared in this manner was compression-tableted by a tableting machine that was a modified Tough Pressed Collect 1527HU manufactured by Kikusui Mfg. Works, Inc. so that the filling amount per tablet was 2.85 g. Thereby, 2500 pieces of Tablet B for developer replenishment use were prepared.

In the course of carrying out the running operations, the above-mentioned tablets A and B were added in an amount of two pieces each per 20×24-inch sheet and water was also added in an amount of 37 ml per sheet to a developer-replenishing tank to prepare a developer-replenishing solution therein. The replenishing solution was replenished in a replenishing amount of 40 ml per 18×22-inch sheet from the replenishing tank to a developing tank, (called Processing A). As for the comparison, the running processing was carried out by replenishing 16 ml of the following concentrated developer and 24 ml of water each per sheet, (called Processing B). The running operations were carried out by replenishing, in an amount of 40 ml per sheet a developer, that was as the same as used at the start and was prepared by 2.5 times diluting the concentrated developer with water. (called Processing C). When making the use of the photographic material exposed to light through a wedge, the sensitivity variations produced in the running processing were evaluated with respect to a decrease of sensitivity at the time after being running-processed for 30 days, as compared to that at the start of the processing. The results thereof are shown together in Table 4.

| Developer concentrated solution (per liter of a developer) | |
|---|---|
| Water | 224 g |
| Potassium carbonate | 55 g |
| Hydroquinone | 20 g |
| Dimezone S | 0.85 g |
| EDTA · 2Na | 1.00 g |
| Potassium bromide | 4.00 g |
| 5-methylbenzotriazole | 0.20 g |
| 1-phenyl-5-mercaptotetrazole | 0.03 g |
| 2-mercaptohypoxanthin | 0.08 g |
| Sodium sulfite | 42.58 g |
| Potassium sulfite | 15.9 g |
| Boric acid | 8.00 g |
| KOH | 10.00 g |
| Diethylene glycol | 40 g |

Water was added to make 400 ml. The pH thereof was adjusted to be 10.78 with potassium hydroxide. The concentrate was 2.5 times diluted with water to make 1 liter, which was used as a starting developer solution (having a pH of 10.40).

| Processing steps | | |
|---|---|---|
| Developing | 35° C. | 30 sec. |
| Fixing | 33° C. | 30 sec. |
| Washing | at an ordinary temperature | 30 sec. |
| Drying | 40° C. | 24 sec. |

TABLE 4

| | Decrease in sensitivity obtained after 30 days running-processing |
|---|---|
| Inventive process (Processing conditions A) | 3% |
| Control process (Processing conditions B) | 45% |
| Control process (Processing conditions C) | 40% |

In the processing of the invention, it was proved that the characteristics can excellently be stable, as compared to the comparative processing.

What is claimed is:

1. An apparatus for processing a silver halide photographic light-sensitive material with a processing solution, comprising:

a processing tank containing the processing solution, and replenishing means for replenishing the processing solution during processing, wherein said replenishing means comprises two replenishing tanks each connected to the processing tank; a solid processing composition and water being supplied to each of the replenishing tanks, in which the solid processing composition is dissolved to prepare a replenishing solution.

2. The apparatus of claim 1, wherein, during the processing, the following actions (i) and (ii) are alternately repeated in each of a first and second replenishing tanks of said replenishing tanks to perform continuous replenishment, (i) while a first replenishing solution of the first replenishing tank is being replenished to said processing tank, the solid processing composition and water are supplied to the second replenishing tank, in which the solid processing composition is dissolved to prepare a second replenishing solution and (ii) when replenishment of the first replenishing solution has been accomplished, the second replenishing solution prepared in the second replenishing tank is replenished to the processing tank.

3. The apparatus of claim 1, wherein said replenishing tanks are each provided with a heating means.

4. The apparatus of claim 1, wherein said replenishing tanks each have a capacity of 1/20 to 1/5 of that of the processing tank.

5. An apparatus for processing a silver halide photographic light-sensitive material comprising:

a developing tank containing a developer solution, a fixing tank containing a fixer solution, and replenishing means for replenishing the developer solution or the fixer solution, wherein said replenishing means comprises two, first and second replenishing tanks; a solid processing composition and water being supplied to the replenishing tanks, in which the solid composition is dissolved to prepare a replenishing solution.

6. The apparatus of claim 5, wherein the following actions (i) and (ii) are alternately repeated in each of said replenishing tanks, (i) while a first replenishing solution in the first replenishing tank is being replenished to the developing or fixing tank, said solid composition and water are supplied to the second replenishing tank to prepare a second replenishing solution therein and (ii) when replenishment of the first replenishing solution has been accomplished, the second replenishing solution prepared in the second replenishing tank is replenished to the developing or fixing tank.

7. The apparatus of claim 6, wherein said replenishing means comprises two, first and second developer-replenishing tanks and two, first and second fixer-replenishing tanks; a solid developer composition and a fixer composition being supplied together with water to the developer-replenishing tanks and the fixer-replenishing tanks, respectively, in which the solid developer composition and solid fixer composition are respectively dissolved to prepare a developer-replenishing solution and a fixer-replenishing solution; and the actions (i) and (ii) are alternately repeated in each of said developer-replenishing tanks and said fixer replenishing tanks.

8. The apparatus of claim 7, wherein said developer-replenishing tanks and fixer-replenishing tanks each are provided with a heating means.

9. The apparatus of claim 7, wherein said developer-replenishing tanks and fixer-replenishing tanks have a capacity of 1/20 to 1/5 of that of said developing tank and fixing tank, respectively.

10. The apparatus of claim 5, wherein said solid processing composition is in the form of granules or a tablet.

11. The apparatus of claim 10, wherein said solid processing composition in a tablet form has a bulk density of 1.0 to 2.5 $g/m^3$.

* * * * *